US009304420B2

(12) United States Patent
Yoshioka et al.

(10) Patent No.: US 9,304,420 B2
(45) Date of Patent: Apr. 5, 2016

(54) TWO-COMPONENT DEVELOPER, DEVELOPING DEVICE, IMAGE FORMING APPARATUS, AND IMAGE FORMING METHOD

(75) Inventors: Nobuyuki Yoshioka, Osaka (JP); Takanori Kamoto, Osaka (JP); Osamu Wada, Osaka (JP); Tadashi Iwamatsu, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 1077 days.

(21) Appl. No.: 12/835,106

(22) Filed: Jul. 13, 2010

(65) Prior Publication Data

US 2011/0008724 A1 Jan. 13, 2011

(30) Foreign Application Priority Data

Jul. 13, 2009 (JP) ..... P2009-165170

(51) Int. Cl.

| | |
|---|---|
| ***G03G 9/107*** | (2006.01) |
| ***G03G 9/08*** | (2006.01) |
| ***G03G 9/087*** | (2006.01) |
| ***G03G 9/113*** | (2006.01) |

(52) U.S. Cl.

CPC ..... *G03G 9/0825* (2013.01); *G03G 9/08782* (2013.01); *G03G 9/1075* (2013.01); *G03G 9/1131* (2013.01); *G03G 9/1136* (2013.01); *G03G 2215/0607* (2013.01)

(58) Field of Classification Search

CPC ..... G03G 9/107; G03G 9/1075
USPC ..... 430/108.1, 111.4, 111.32, 111.3, 106.1, 430/122.4, 122.2, 108.8; 399/252
See application file for complete search history.

(56) References Cited

U.S. PATENT DOCUMENTS

| | | | | |
|---|---|---|---|---|
| 5,643,705 | A * | 7/1997 | Inoue et al. | 430/108.8 |
| 5,935,751 | A | 8/1999 | Matsuoka et al. | |
| 2002/0051925 | A1* | 5/2002 | Matsumura et al. | 430/110.3 |
| 2002/0177061 | A1* | 11/2002 | Kobayashi et al. | 430/111.32 |
| 2003/0113650 | A1* | 6/2003 | Suwabe et al. | 430/120 |
| 2007/0092821 | A1* | 4/2007 | Sato et al. | 430/108.4 |
| 2007/0141502 | A1* | 6/2007 | Aga et al. | 430/111.32 |
| 2008/0014514 | A1 | 1/2008 | Kamoto | |
| 2008/0241729 | A1* | 10/2008 | Kayamoto et al. | 430/111.32 |

FOREIGN PATENT DOCUMENTS

| | | |
|---|---|---|
| CN | 101105652 A | 1/2008 |
| JP | 09-146307 | 6/1997 |
| JP | 9-160284 | 6/1997 |

(Continued)

*Primary Examiner* — Peter Vajda
*Assistant Examiner* — Olatunji Godo
(74) *Attorney, Agent, or Firm* — Nixon & Vanderhye P.C.

(57) ABSTRACT

A two-component developer is provided. The two-component developer includes a toner containing a binder resin, a colorant and a release agent, and a resin-coated carrier composed of a carrier core material and a resin coating layer formed on a surface of the carrier core material. The toner has an exposure rate of the release agent on the toner surface of 1.00% or above and 3.07% or below. The carrier core material has an apparent density of 1.86 g/cm$^3$ or more and 2.45 g/cm$^3$ or less. The exposure rate of the release agent of the toner and the apparent density of the carrier core material satisfy the following formula (1):

$$y \leq -1.54x + 5.93 \quad (1)$$

wherein y represents the exposure rate of the release agent of the toner, and x represents the apparent density of the carrier core material.

4 Claims, 5 Drawing Sheets

(56) References Cited

FOREIGN PATENT DOCUMENTS

| | | |
|---|---|---|
| JP | 9-319158 | 12/1997 |
| JP | 10-207116 | 8/1998 |
| JP | 10-239902 | 9/1998 |
| JP | 2002-107996 | 4/2002 |
| JP | 2006-259010 | 9/2006 |
| JP | 2008-20578 | 1/2008 |
| JP | 2009-064008 | 3/2009 |

* cited by examiner

TWO-COMPONENT DEVELOPER, DEVELOPING DEVICE, IMAGE FORMING APPARATUS, AND IMAGE FORMING METHOD

CROSS-REFERENCE TO RELATED APPLICATION

This application claims priority to Japanese Patent Application No. 2009-165170, which was filed on Jul. 13, 2009, the contents of which are incorporated herein by reference in its entirety.

BACKGROUND OF THE INVENTION

Field of the Invention

The present invention relates to a two-component developer used in electrophotography which develops an electrostatic latent image formed on an image bearing member and visualizes the latent image, a developing device using the two-component developer, an image forming apparatus, and an image forming method.

Office automation (abbreviated as "OA") equipment has been remarkably developed in these days and in line with such development, there has been a wide spread of copiers, printers, facsimile machines, and the like machines which form images through electrophotography.

For example, an image is formed by way of a charging step, an exposing step, a developing step, a transferring step, a fixing step, and a cleaning step in an image forming apparatus which employs electrophotography. At the charging step, a surface of a photoreceptor serving as an image bearing member is evenly charged in a dark place. At the exposing step, the charged photoreceptor receives signal light derived from a document image, resulting in removal of charges on the exposed part of the photoreceptor whose surface thus bears an electrostatic image (an electrostatic latent image). At the developing step, an electrostatic-image-developing toner (hereinafter simply referred to as "toner" unless otherwise mentioned) is supplied to the electrostatic image on the surface of the photoreceptor, thereby forming a toner image (a visualized image). At the transferring step, the toner image on the surface of the photoreceptor is transferred onto the recording medium by providing the recording medium with charges of which polarity is opposite to that of charges of the toner. At the fixing step, the toner image is fixed on the recording medium by heat, pressure, or the like. At the cleaning step, the toner is collected which has not been transferred onto the recording medium and thus remains on the surface of the photoreceptor. Through the above steps, a desired image is formed by the image forming apparatus employing electrophotography.

In an image forming apparatus employing electrophotography, a one-component developer containing only a toner, or a two-component developer containing a toner and a carrier is used as a developer for developing an electrostatic charge image on a photoreceptor. The two-component developer is given functions of stirring, transportation and charging of a toner by a carrier. Therefore, the two-component developer does not require the toner to have a function of a carrier, and has the characteristics that function is separated, controllability is improved and a high quality image is easy to be obtained, as compared with the one-component toner containing a toner alone.

At the present, a magnetic brush method using a magnetic roll as a developer bearing member is a mainstream as a method of developing an electrostatic charge image on a photoreceptor surface.

For example, a heat-melt system is used as a method fixing a toner image transferred to a recording medium. A contact-type heating roller used in the heat-melt system has good heat efficiency and enables high speed fixing, and is therefore used in various electrophotography-related commercial products.

The contact-type heating roller may cause offset phenomenon that a toner on a recording medium adheres to a heating roller at the time of fixing. For example, a release agent is contained in a toner to prevent the offset phenomenon. However, in forming an image, a release agent exposed on a toner surface is easy to melt by temperature rising in the inside of a development tank due to rotation of a developing roller in the inside of the developer tank and heat from a fixing section. When the release agent exposed on a toner surface melts, cohesion force is generated between a toner and a carrier in the two-component developer, starting the portion as a base point, a toner and a carrier become massed together, and fluidity of the two-component developer is decreased. Furthermore, the release agent fuses and fixes to a regulatory blade. This decreases charging property and developability of a toner and deteriorates image quality. In the case that an image is formed using a recording medium having a rough surface on which transfer is difficult to conduct smoothly as compared with a recording medium having a smooth surface, deterioration of image quality appears remarkably. A developer increases mechanical stress to a toner and increases an amount of a release agent exposed on a toner surface as the period exposed to high temperature is long, contact area between a release agent exposed on a toner surface and a carrier is large, the amount of a release agent exposed on a toner surface is large and weight of a carrier combined with a toner is large, at the time of use thereof. As a result, adhesion force between a toner and a carrier is increased.

To overcome those problems, Japanese Unexamined Patent Publication JP-A 9-319158 (1997) discloses an electrostatic latent image developer comprising a carrier and a toner, wherein the carrier comprises a core material having formed thereon a resin coating layer comprising resin fine particles comprising a resin such as melamine or guanamine containing nitrogen atom, dispersed therein, the toner comprises a binder resin, a colorant and a wax, an exposure rate of the wax on a toner surface is 15 to 40% by weight, and when the amount of the wax contained in the toner is Y, the relationship between the wax amount and a wax exposure rate X (% by weight) on the toner surface is a range of $40 \leq X \times Y \leq 240$. According to JP-A 9-319158, an electrostatic latent image developer which can suppress spent of a toner to a carrier, blocking of a toner and fusion to a regulatory blade, has a wide fixable temperature region, has good fluidity, has little environmental dependency and has extremely long life can be obtained.

Japanese Unexamined Patent Publication JP-A 9-160284 (1997) discloses an electrostatic charge image developer comprising a carrier comprising core particles coated with a silicone resin, a fluorine resin, an acrylic resin or the like and having a volume resistance of $10^7$ to $10^9$ Ω·cm, and toner particles containing a modified polyethylene wax. According to JP-A 9-160284, an electrostatic charge image developer which has excellent offset resistance, powder fluidity and blocking resistance, and can stably form an image having excellent scratching strength over a long period of time without receiving damage by peeling paws in a fixing roll part can be obtained.

Japanese Unexamined Patent Publication JP-A 2008-20578 discloses an electrostatic charge image development toner comprising toner base particles containing a binder resin and a release agent, and at least one external additive, wherein an exposure rate of the release agent on a toner base particle surface measured by X-ray photoelectron spectroscopy (XPS) is a range of 10 to 40%; and of the toner base particle surface, an existing rate of the external additives in a release agent exposure area on a toner base particle surface is 15% or less, and an existing rate of the external additives on an area other than the release agent is 20 to 100%. According to JP-A 2008-20578, an electrostatic charge image development toner having both good fixability and good powder fluidity and free of the problems such as hot offset can be obtained.

However, the toner contained in the electrostatic latent image developer disclosed in JP-A 9-319158 has too large wax exposure rate on the toner surface. For this reason, increase in adhesion force between a toner and a carrier due to rising of temperature in the inside of a development tank cannot sufficiently be controlled. As a result, fluidity of a developer cannot sufficiently be prevented from decreasing. Furthermore, in recent years, reduction in size and high-speed of an image forming apparatus progresses, and temperature in the inside of a development tank is further increased by the progress. As a result, decrease in fluidity of a developer becomes further remarkable.

The electrostatic charge image developer disclosed in JP-A 9-160284 comprises a resin-coated carrier having a specified volume resistance, and a toner containing a polyethylene wax resin as a waxing compound. However, the developer cannot sufficiently reduce adhesion force of a toner to a coating resin material of a carrier. For this reason, increase in adhesion farce between a toner and a carrier cannot sufficiently be suppressed at the time of temperature rising in the inside of the development tank, and fluidity of a developer is decreased.

The electrostatic charge image development toner disclosed in JP-A 2008-20578 defines the existing rate of the external additives in the release agent exposure area on the toner base particle surface. Because the exposure rate of the release agent on the toner base particle surface is too high, increase in adhesion force between a toner and a carrier due to temperature rising in the inside of a development tank cannot sufficiently be suppressed. As a result, fluidity of a developer cannot sufficiently be prevented from decreasing. Furthermore, in recent years, reduction in size and high-speed of an image forming apparatus progresses, and temperature in the inside of a development tank is further increased by the progress. As a result, decrease in fluidity of a developer becomes further remarkable.

SUMMARY OF THE INVENTION

An object of the invention is to provide a two-component developer that has excellent fluidity, can stably charge a toner and can stably form a high quality image over a long period of time, as well as a developing device using the two-component developer, an image forming apparatus that can stably form a high quality image over a long period of time by using the two-component developer, and an image forming method using the two-component developer.

The invention provides a two-component developer comprising a toner including a binder resin, a colorant and a release agent, the toner having an exposure rate of the release agent on the toner surface of 1.00% or above and 3.07% or below, and a resin-coated carrier comprising a carrier core material and a resin coating layer formed on a surface of the carrier core material, the carrier core material having an apparent density of 1.86 g/cm$^3$ or more and 2.45 g/cm$^3$ or less, the exposure rate of the release agent on the toner surface and the apparent density of the carrier core material satisfying the following formula (1):

$$y \leq -1.54x + 5.93 \quad (1)$$

wherein y represents the exposure rate of the release agent on the toner surface, and x represents the apparent density of the carrier core material.

According to the invention, the two-component developer comprises a toner and a resin-coated carrier. The toner includes a binder resin, a colorant and a release agent. The resin-coated carrier comprises a carrier core material and a resin coating layer formed on a surface of the carrier core material. The toner has an exposure rate of the release agent on the toner surface of 1.00% or above and 3.07% or below. The carrier core material has an apparent density of 1.86 g/cm$^3$ or more and 2.45 g/cm$^3$ or less. The exposure rate of the release agent on the toner surface and the apparent density of the carrier core material satisfy the above formula (1).

The two-component developer in which the exposure rate of the release agent and the apparent density of the carrier core material satisfy the above formula (1) is a two-component developer having excellent fluidity. For example, in the case of using a toner having relatively large exposure rate of the release agent, a resin-coated carrier comprising a carrier core material having relatively small apparent density is used. This can reduce driving torque of a stirring screw which stirs the two-component developer, and can form a two-component developer having excellent fluidity. In the case of using a resin-coated carrier comprising a carrier core material having relatively large apparent density, a toner having relatively small exposure rate of the release agent is used. This can reduce adhesion force between a toner and a resin-coated carrier, and can form a two-component developer having excellent fluidity. Use of such a two-component developer having excellent fluidity can stably charge a toner, and can stably form a high quality image over a long period of time.

Further in the invention, it is preferable that the toner has a dispersion diameter of a release agent exposed on the toner surface of less than 300 nm.

According to the invention, the toner has a dispersion diameter of a release agent exposed on the toner surface of less than 300 nm. When the toner has a dispersion diameter of a release agent exposed on the toner surface of less than 300 nm, a contact area between the release agent exposed on the toner surface and a resin-coated carrier can be decreased. This can further reduce adhesion force between a toner and a resin-coated carrier, and can improve fluidity.

Further in the invention, it is preferable that the carrier core material has a volume average particle size of 25 μm or more and 50 μm or less.

According to the invention, the carrier core material has a volume average particle size of 25 μm or more and 50 μm or less. When the volume average particle size of the carrier core material falls with a range of 25 μm or more and 50 μm or less, the resin-coated carrier can obtain magnetic force to a development roller, and is therefore easy to be supported by the development roller. As a result, transition of a resin-coated carrier to an image bearing member, that is, carrier adhesion to an image bearing member, can be reduced. Furthermore, when the volume average particle size of the carrier core material falls in the above range, the resin-coated carrier can sufficiently charge a toner. This can suppress deterioration of image quality due to carrier adhesion to an image bearing member, and can form a high definition image.

Further in the invention, it is preferable that the resin coating layer contains a silicone resin having a coupling agent dispersed therein.

According to the invention, the resin coating layer contains a silicone resin having a coupling agent dispersed therein. A silicone resin has small surface energy. Therefore, when the resin coating layer contains a silicone resin, releasability between a toner and a resin-coated carrier can be increased. The silicone resin has relatively poor adhesion to a carrier core material. When a coupling agent is dispersed in the silicone resin, bonding force between a carrier core material and a resin coating layer can be improved. Therefore, when the resin coating layer comprises a silicone resin having a coupling agent dispersed therein, releasability between a toner and a resin-coated carrier, and adhesion between a carrier core material and a resin coating layer can be achieved together. As a result, adhesion force between a toner and a resin-coated carrier can further be reduced.

Further in the invention, it is preferable that the resin-coated carrier comprises a resin coating layer containing a conductive agent, and has a volume resistance of $10^{10}$ Ω·cm or more and $10^{14}$ Ω·cm or less.

According to the invention, the resin-coated carrier comprises a resin coating layer containing a conductive agent, and has a volume resistance of $10^{10}$ Ω·cm or more and $10^{14}$ Ω·cm or less. Where the volume resistance of the resin-coated carrier is less than $10^{10}$ Ω·cm, charge injection to a resin-coated carrier is liable to cause from a development sleeve, and carrier adhesion to an image bearing member occurs. Where the volume resistance the resin-coated carrier exceeds $10^{14}$ Ω·cm, influence of carrier adhesion to an image bearing member is small, but on the other hand, development electric field between a photoreceptor and a development sleeve is weakened. As a result, an image cannot be developed in detail, and fine line reproducibility of an image obtained is decreased. When the volume resistance of the resin-coated carrier falls within a range of $10^{10}$ Ω·cm or more and $10^{14}$ Ω·cm or less, carrier adhesion to an image bearing member can be reduced, and an image can be developed in detail. As a result, a high definition image can be formed.

Further in the invention, it is preferable that the carrier core material is soft ferrite having remanent magnetization of 10 emu/g or less and an apparent density of 1.86 g/cm$^3$ or more and 2.10 g/cm$^3$ or less.

According to the invention, the carrier core material is soft ferrite having remanent magnetization of 10 emu/g or less and an apparent density of 1.86 g/cm$^3$ or more and 2.10 g/cm$^3$ or less. When magnetic oxide is soft ferrite, remanent magnetization of the carrier core material is small as 10 emu/g or less and an apparent density of the carrier core material is small as 1.86 g/cm$^3$ or more and 2.10 g/cm$^3$ or less, driving torque of a stirring screw which stirs a two-component developer can be reduced, and a resin-coated carrier which is easy to separate from a magnet roller or the like can be formed. As a result, fluidity can further be improved, and a toner can further stably be charged.

The invention provides a developing device that develops an electrostatic latent image formed on an image bearing member to form a toner image, using the two-component developer mentioned above.

According to the invention, the developing device develops an electrostatic latent image formed on an image bearing member to form a toner image, using the two-component developer. Therefore, development of an electrostatic latent image can be conducted with a toner having stable charge amount, and a high definition toner image free of fogging can stably be formed over a long period of time.

The invention provides an image forming apparatus comprising:

the developing device mentioned above which develops an electrostatic latent image formed on an image bearing member to form a toner image, and a transfer section comprising an intermediate transfer member to which the toner image formed on the image bearing member is to be transferred.

According to the invention, the image forming apparatus comprises the developing device of the invention which develops an electrostatic latent image formed on an image bearing member to form a toner image, and a transfer section comprising an intermediate transfer member to which the toner image formed on the image bearing member is to be transferred. The developing device of the invention can stably form a high definition toner image free of fogging over a long period of time. Therefore, even in the image forming apparatus of the invention comprising an intermediate transfer member and having a mechanism which transfers a toner image two times, a high quality image that reproduces an image in high definition, has good color reproduction and high image density, and is free of image defects such as fogging can stably be produced over a long period of time.

The invention provides an image forming method comprising developing an electrostatic latent image formed on an image bearing member using the two-component developer mentioned above to form a toner image, and forming a monochromatic image or a multicolor image based on the toner image.

According to the invention, the image forming method develops an electrostatic latent image formed on an image bearing member using the two-component developer to form a toner image, and forms a monochromatic image or a multicolor image based on the toner image. The two-component developer of the invention can stably charge a toner. Therefore, a multicolor image having excellent image reproducibility including color reproducibility and having high definition and high image density can stably be formed over a long period of time.

Further in the invention, it is preferable that after the toner image formed on an image bearing member is primarily transferred to an intermediate transfer member, the toner image transferred to the intermediate transfer member is secondarily transferred to a recording medium, thereby forming a monochromic image or a multicolor image based on the toner image on the recording medium.

According to the invention, after the toner image formed on an image bearing member is primarily transferred to an intermediate transfer member, the toner image transferred to the intermediate transfer member is secondarily transferred to a recording medium, thereby forming a monochromic image or a multicolor image based on the toner image on the recording medium. Use of the two-component developer of the invention can stably charge a toner. Therefore, even in the method of the invention that a toner image is transferred two times using intermediate transfer, a high quality image which reproduces an image in high definition, has good color reproducibility and high color density and is free of image defects such as fogging can stably be formed over a long period of time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
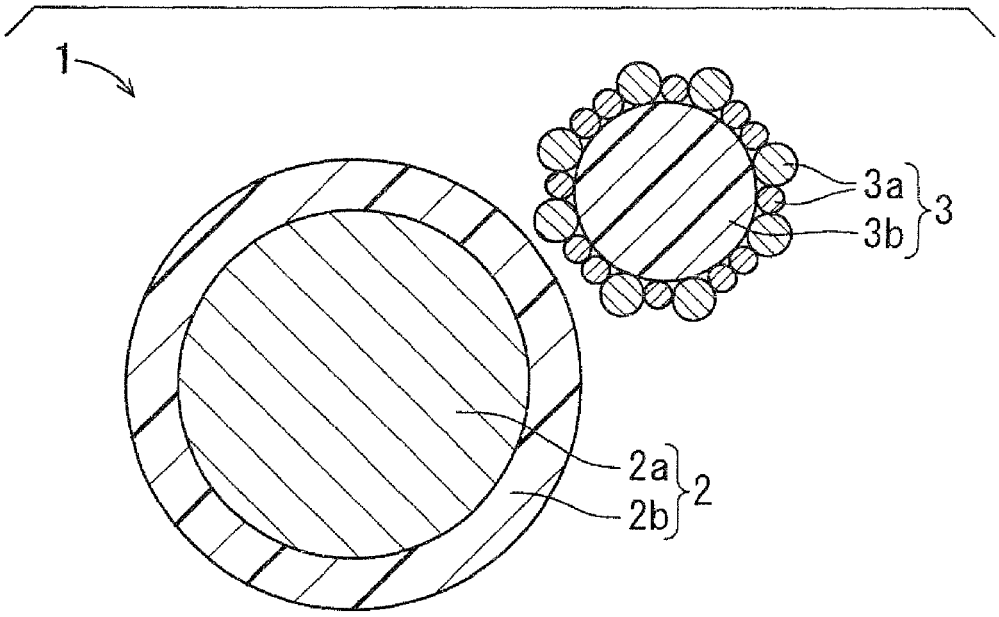
FIG. 1 is a cross-sectional view schematically showing a constitution of a two-component developer according to a first embodiment of the invention.

Now referring to the drawings, preferred embodiments of the invention are described below.

1. Two-component Developer

FIG. 1 is a cross-sectional view schematically showing a constitution of a two-component developer 1 which is a first embodiment of the invention. As shown in FIG. 1, the two-component developer of the embodiment comprises a toner 3 and a resin-coated carrier 2.

(1) Toner

The toner 3 comprises a toner base particle 3*b* and at least two of external additives 3*a* having different particle size. The toner base particle 3*b* comprises a binder resin, a colorant and a release agent, as essential components, and further comprises a charge control agent.

(Binder Resin)

The binder resin is not particularly limited, and can use the conventional binder resins for a black toner or a color toner. Examples of the binder resin include polyester-based resins; styrene-based resins such as polystyrene and a styrene-acrylic acid ester copolymer resin; acrylic resins such as polymethyl methacrylate; polyolefin-based resins such as polyethylene; polyurethane; and epoxy resins. Resins obtained by mixing a release agent with a raw material monomer mixture and conducting a polymerization reaction may be used. The binder resins may be used each alone, or two or more of them may be used in combination.

In a case of using the polyester resin as the binder resin, examples of the aromatic alcohol ingredient required for obtaining the polyester resin include bisphenol A, polyoxyethylene-(2.2)-2,2-bis(4-hydroxyphenyl)propane, polyoxyethylene-(2.0)-2,2-bis(4-hydroxyphenyl)propane, polyoxypropylene-(2.0)-2,2-bis(4-hydroxyphenyl)propane, polyoxypropylene-(2.2)-polyoxyethylene-(2.0),-2,2-bis(4-hydroxyphenyl)propane, polyoxypropylene-(6)-2,2-bis(4-hydroxyphenyl)propane, polyoxypropylene-(2.2)-2,2-bis(4-hydroxyphenyl)propane, polyoxypropylene-(2.4)-2,2-bis(4-hydroxyphenyl)propane, polyoxypropylene-(3.3)-2,2-bis(4-hydroxyphenyl)propane, and derivatives thereof.

Further, examples of the polybasic acid ingredient in the polyester resin include dibasic acids such as succinic acid, adipic acid, sebasic acid, azelaic acid, dodecenyl succinic acid, n-dodecyl succinic acid, malonic acid, maleic acid, fumaric acid, citraconic acid, itaconic acid, glutaconic acid, cyclohexane dicarboxylic acid, ortho-phthalic acid, isophthalic acid, and terephthalic acid, tri- or higher basic acids such as trimellitic acid, trimethinic acid, and pyromellitic acid, as well as anhydrides and lower alkyl esters thereof. With a view point of heat resistant cohesion, terephthalic acid or lower alkyl esters thereof are preferred.

Here, the acid value of the polyester resin constituting the toner is preferably 5 to 30 mgKOH/g. In a case where the acid value is less than 5 mgKOH/g, the charging characteristic of the resin is lowered, and the organic bentonite as the charge controller is less dispersible in the polyester resin. They give undesired effects on the rising of the charged amount and the stability of the charged amount by repetitive development in continuous use. Accordingly, the above-mentioned range is preferable.

(Colorant)

As a colorant, various kinds of colorants are usable in accordance with a desired color; for example, a yellow toner colorant, a magenta toner colorant, a cyan toner colorant, a black toner colorant and the like.

As a yellow toner colorant, examples thereof include, in reference to the color index classification, an azo dye such as C. I. Pigment Yellow 1, C. I. Pigment Yellow 5, C. I. Pigment Yellow 12, C. I. Pigment Yellow 15 and C. I. Pigment Yellow 17, an inorganic pigment such as a yellow iron oxide or an ocher, a nitro dye such as C. I. Acid Yellow 1, an oil soluble dye such as C. I. Solvent Yellow 2, C. I. Solvent Yellow 6, C. I. Solvent Yellow 14, C. I. Solvent Yellow 15, C. I. Solvent Yellow 19 or C. I. Solvent Yellow 21.

As a magenta toner colorant, examples thereof include, in reference to the color index classification, C. I. Pigment Red 49, C. I. Pigment Red 57, C. I. Pigment Red 81, C. I. Pigment Red 122, C. I. Solvent Red 19, C. I. Solvent Red 49, C. I. Solvent Red 52, C. I. Basic Red 10 and C. I. Disperse Red 15.

As a cyan toner colorant, examples thereof include, in reference to the color index classification, C. I. Pigment Blue 15, C. I. Pigment Blue 16, C. I. Solvent Blue 55, C. I. Solvent Blue 70, C. I. Direct Blue 25 and C. I. Direct Blue 86.

As a black toner colorant, examples thereof include carbon blacks such as channel black, roller black, disk black, gas furnace black, oil furnace black, thermal black, and acetylene black. The carbon black may be selected properly from among various kinds of carbon blacks mentioned above according to a target design characteristic of toner.

In addition to these pigments, a bright red pigment, a green pigment and the like are also usable as a colorant. The colorants may be used each alone, or two or more of them may be used in combination. Further, two or more of the similar color series are usable, or one of or two or more of the different color series are also usable.

The colorant may be used in the form of a masterbatch. The masterbatch of the colorant can be produced in the same manner as a general masterbatch. For example, a melted synthetic resin and a colorant are kneaded so that the colorant is uniformly dispersed in the synthetic resin, then the resultant mixture thus melt-kneaded is granulated to produce a masterbatch. For the synthetic resin, the same kind as the binder resin of the toner, or a synthetic resin having excellent compatibility with the binder resin of the toner is used. At this time, a ratio of the synthetic resin and the colorant to be used is not particularly restricted, but preferably 30 to 100 parts by weight based on 100 parts by weight of the synthetic resin. Further, the masterbatch is granulated so as to have a particle size of about 2 to 3 mm.

The amount of a colorant to be used is not particularly restricted, but preferably 5 to 20 parts by weight based on 100 parts by weight of the binder resin. This amount does not refer to the amount of the masterbatch, but to the amount of the colorant itself included in the masterbatch. By using a colorant within such a range, it is possible to form a high-density and extremely high-quality image without damaging various physical properties of the toner.

(Release Agent)

The release agent can use the one commonly used in this field, and examples thereof include a petroleum wax such as a paraffin wax and a derivative thereof; a microcrystalline wax and a derivative thereof; a hydrocarbon synthetic wax such as a Fischer-Tropsch wax and a derivative thereof; a polyolefin wax and a derivative thereof; a low-molecular-weight polypropylene wax and a derivative thereof; a polyolefin polymer wax (a low-molecular-weight polyethylene wax and the like) and a derivative thereof; a botanical wax such as a carnauba wax and a derivative thereof; a rice wax and a derivative thereof; a candelilla wax and a derivative thereof; a plant wax such as a Japan wax; an animal wax such as a beeswax and a spermaceti wax; a synthetic wax of fat and oil such as a fatty acid amide and a phenol fatty acid ester; a long-chain carboxylic acid and a derivative thereof; a long-chain alcohol and a derivative thereof; a silicone polymer; and a higher fatty acid. Note that examples of the derivatives include an oxide, a vinyl monomer-wax block copolymer and a vinyl monomer-wax graft modified material.

The content of the release agent is not particularly limited and can appropriately be selected from a wide range. The content is preferably 0.2 to 20 parts by weight based on 100 parts by weight of the binder resin. Furthermore, the content is 2.5% by weight or above and 6.0% by weight or below based on the total weight of the toner.

The release agent is exposed on the surface of the toner 3. In the embodiment, an exposure rate of the release agent on the toner 3 surface is 1.00% or above and 3.07% or below. Where the exposure rate of the release agent on the toner 3 surface is less than 1.00%, releasability of the toner 3 to a fixing roller as the fixing section is decreased, and fixability is deteriorated. Where the exposure rate of the release agent on the toner 3 surface exceeds 3.07%, fluidity of the two-component developer 1 is decreased. When the exposure rate of the release agent on the toner 3 surface is 1.00% or above and 3.07% or below, good fixability and fluidity can be achieved.

The exposure rate of the release agent on a surface of the toner 3 (hereinafter simply referred to as "exposure rate of the release agent") means a rate of a release agent present on the toner particle surface. The exposure rate of the release agent is obtained from difference in heat capacity between toner particles in which a release agent present on the toner particle surface has been eluted in a solvent such as alcohol, and toner particles before the treatment, in which a release agent is not eluted.

The exposure rate of the release agent can be adjusted to the above range by adjusting the content of the release agent in preparing the toner 3. However, because the exposure rate of the release agent varies depending on, for example, the preparation conditions of the toner 3, the exposure rate of the release agent is preferably obtained every toner 3 by the above method. The preparation conditions of the toner 3 includes a size of a release agent used, and melt-kneading conditions in the case of a toner prepared by a production method including a melt-kneading step.

In the embodiment, a dispersion diameter of the release agent exposed on the surface of the toner 3 is preferably less than 300 nm. When the dispersion diameter of the release agent exposed on the surface of the toner 3 is less than 300 nm, a contact area between the release agent exposed on the surface of the toner 3 and the resin-coated carrier 2 can be decreased. As a result, adhesion force between the tone 3 and the resin-coated carrier 2 can further be reduced, and fluidity can be improved. The dispersion diameter of the release agent exposed on the surface of the toner 3 can be obtained by removing a release agent exposed on the toner surface by eluting the release agent in an organic solvent and image-analyzing a microgram of toner particles obtained. To adjust the dispersion diameter to the above range, for example, in the case of preparing the toner 3 by a production method including a melt-kneading step, time for pre-mixing a release agent and melt-kneading conditions are adjusted.

(Charge Control Agent)

The charge control agent is added for the purpose of controlling frictional charging property of the toner 3. The charge control agent can use charge control agents for controlling positive charge or for controlling negative charge, conventionally used in this field. Examples of the charge control agent for controlling positive charge include basic dyes, quaternary ammonium salts, quaternary phosphonium salts, aminopyrine, pyrimidine compounds, multinuclear polyamino compounds, aminosilane, nigrosine dyes and its derivative, triphenylmethane derivatives, guanidine salts and amidine salts.

Examples of the charge control agent for controlling negative charge include oil-soluble dyes such as oil black and spirone black; metal-containing azo compounds, azo complex dyes, naphthenic acid metal salts, metal complexes and metal salts of salicylic acid and its derivative (metal is chromium, zinc, zirconium and the like), boron compounds, fatty acid soaps, long-chain alkyl carboxylic acid salts, and resin acid soaps. Among them, the boron compound is particularly preferred as being free of heavy metal.

The charge control agents for controlling positive charge and the charge control agent for controlling negative charge are used according to the respective purpose of use. The charge control agents may be used each alone, or two or more of them may be used in combination, according to need. The amount of the charge control agent used is not particularly limited and can appropriately be selected from a wide range. The amount of the charge control agent used is preferably 0.5 to 3 parts by weight based on 100 parts by weight of the binder resin.

(External Additive)

The external additive 3*a* of the toner 3 can use external additives conventionally used in this field, and examples thereof include silicon oxide, titanium oxide, silicon carbide, aluminum oxide and barium titanate. In the embodiment, at least two of external additives 3*a* having different particle size are used together, and at least one of the external additive has a volume average particle size of primary particle size of 0.1 μm or more and 0.2 μm or less. When at least one of an external additive having a primary particle size of 0.1 μm or more is used as the external additive, transferability is improved in particularly a color toner, and at the same time, the toner 3 can stably be charged in the long term without inducing decrease in charging due to adhesion of the external additive to a carrier surface. The amount of the external additive 3*a* used is not particularly limited. The amount is preferably 0.1 to 3.0 parts by weight based on 100 parts by weight of the toner. The external additive 3*a* may not externally be added to the toner base particle 3*b*, and the toner base particle 3*b* may directly be used as the toner 3.

(Preparation Method of Toner)

Raw materials of the toner 3 excluding the external additive 3*a* are pre-mixed by a mixing machine such as a Henschel mixer, a super mixer and a Q-type mixer. A raw material mixture thus obtained is melt-kneaded at a temperature of about 70 to 180° C. by a kneading machine such as a twin-screw kneading machine, a single-screw kneading machine and a continuous two-roll type kneading machine, and the melt-kneaded mixture is cooled and solidified. The melt-kneaded mixture of raw materials of the toner 3 after cooling and solidifying is coarsely pulverized by a cutter mill, a feather mill or the like. The coarsely pulverized product obtained is finely pulverized. Fine pulverization is conducted using a jet mill, a fluidized bed-type jet pulverizer or the like. Those pulverizers conduct pulverization of toner particles by colliding toner particles to each other by colliding air flows containing toner particles from plural directions. This can produce non-magnetic toner base particles 3*b* having a specific particle size distribution. The particle size of the toner base particles 3*b* is not particularly limited, but a volume average particle size is preferably in a range of 3 to 10 μm. According to need, particle size adjustment such as classification may further be conducted. The external additives 3*a* are added to the toner base particles 3*b* thus produced, by the conventional methods. The production method of the toner 3 is not limited to the above method.

(2) Resin-Coated Carrier

The resin-coated carrier 2 comprises the carrier core material 2*a* and the resin coating layer 2*b* formed on the surface of the carrier core material 2*a*.

(Carrier Core Material)

As the carrier core material 2*a*, particles having magnetic property can be used. Specific examples of the particles having magnetic property include metals such as iron, ferrite and magnetite, and alloys of those metals and metals such as aluminum or lead. Among them, ferrite is preferred.

Ferrite includes soft ferrite showing soft magnetic property and ferrite showing hard magnetic property. In the embodiment, magnetic oxide is preferably hard ferrite. Hard ferrite is magnet, and therefore has large remanent magnetization. Where magnetic oxide is hard ferrite, resin-coated carrier particles are adhered to each other, thereby fluidity of the two-component developer 1 may be decreased and the resin-coated carrier particles may be difficult to separate from a magnet roller. However, when the magnetic oxide is soft ferrite, remanent magnetization of the carrier core material 2*a* can be decreased, fluidity of the two-component developer is good, and the resin-coated carrier 2 which is easy to separate from a magnet roller can be formed.

In the embodiment, the carrier core material 2*a* has an apparent density of 1.86 g/cm$^3$ or more and 2.45 g/cm$^3$ or less. This can suppress carrier adhesion to an image bearing member, and additionally, can achieve excellent fluidity.

The carrier core material 2*a* preferably has remanent magnetization of 10 emu/g or less, and an apparent density of 2.10 g/cm$^3$ or less. When the remanent magnetization of the carrier core material 2*a* is small as 10 emu/g or less and the apparent density of the carrier core material 2*a* is small as 2.10 g/cm$^3$ or less, adhesion force between the toner 3 and the resin-coated carrier 2 can be reduced, and furthermore, the resin-coated carrier 2 which is easy to separate from a magnet roller can be obtained. For this reason, fluidity of the two-component developer 1 can further be improved, and the toner 3 can further stably be charged.

The carrier core material 2*a* having relatively small density such that the apparent density is 2.10 g/cm$^3$ or less can be obtained by, for example, forming voids in the inside of the carrier core material 2*a*, and can be prepared by, for example, a resin addition method. The resin addition method is described in detail hereinafter.

The apparent density of the carrier core material 2*a* can be decreased by containing non-magnetic oxide having true density of 3.5 g/cm$^3$ or less in the carrier core material 2*a* together with the above-described magnetic oxide. Specifically, silica is contained in the inside of the carrier core material 2*a* in place of forming voids in the carrier core material 2*a*. Such a method includes a silica particle addition method, and silica having true density of around 2 g/cm$^3$ is contained in the carrier core material 2*a* together with ferrite having true density of around 4.9 g/cm$^3$. This silica addition method is described in detail hereinafter.

The carrier core material 2*a* preferably has a volume average particle size of 25 μm or more and 50 μm or less. When the volume average particle size of the carrier core material 2*a* is 25 μm or more and 50 μm or less, the resin-coated carrier 2 can have sufficient magnetic force to a development roller, and can be easy to be supported on a development roller. As a result, transition of the resin-coated carrier 2 to the image bearing member, that is, carrier adhesion, can be reduced. Furthermore, when the volume average particle size of the carrier core material 2*a* falls in the above-described range, the resin-coated carrier can sufficiently charge the toner 3. As a result, deterioration of image quality due to carrier adhesion to the image bearing member can be suppressed, and a high definition image can be formed.

(Resin Coating Layer)

Examples of the resin used in the resin coating layer 2*b* (hereinafter referred to as a "coating resin") include olefin-based resins, styrene-based resins, styrene-acryl-based resins, silicone-based resins, ester-based resins and fluorine-containing polymer-based resins. Of those resins, silicone resins are preferred.

In the case of using a cross-linked silicone resin as a silicone resin, commercially available cross-linked silicone resins can be used, and examples thereof include SR2400, SR2410, SR2411, SR2510, SR2405, 840RESIN and 804RESIN (all trade names, manufactured by Dow Corning Toray Co., Ltd.), and KR271, KR272, KR274, KR216, KR280, KR282, KR261, KR260, KR255, KR266, KR251, KR155, KR152, KR214, KR220, X-4040-171, KR201, KR5202 and KR3093 (all trade names, manufactured by Shin-Etsu Chemical Co., Ltd.). The cross-linked silicone resins may be used each alone, or two or more of them may be used in combination.

The resin coating layer 2*b* may contain a charge control agent. The resin-coated carrier containing a carrier core material having small apparent density is relatively poor in toner charging property. However, when the resin coating layer 2*b* contains a charge control agent, the charge control agent supplements toner charging property by the resin-coated carrier, and this can make toner charging property good.

As the charge control agent, charge control agents for controlling positive charge or for controlling negative charge can be used. Examples of the charge control agent for controlling positive charge include basic dyes, quaternary ammonium salts, quaternary phosphonium salts, aminopyrine, pyrimidine compounds, multinuclear polyamino compounds, aminosilane, nigrosine dyes and its derivative, triphenylmethane derivatives, guanidine salts and amidine salts. Examples of the charge control agent for controlling negative charge include oil-soluble dyes such as oil black and spirone black; metal-containing azo compounds, azo complex dyes, naphthenic acid metal salts, metal complexes and metal salts of salicylic acid and its derivative (metal is chromium, zinc, zirconium and the like), boron compound, fatty acid soaps, long-chain alkyl carboxylic acid salts, and resin acid soaps. The charge control agents may be used each alone, or two or more of them may be used in combination.

The amount of the charge control agent added is preferably from 1 to 10% by weight based on the total weight of a coating resin solution described hereinafter.

(Resin-coated Carrier)

The shape of the resin-coated carrier 2 is preferably a spherical shape or a flat shape. The volume average particle size of the resin-coated carrier 2 is not particularly limited. Considering high image quality, the volume average particle size is preferably 10 μm or more and 100 μm or less, and more preferably 25 μm or more and 50 μm or less. Where the volume average particle size of the resin-coated carrier 2 is less than 10 μm, magnetic force between the resin-coated carrier 2 and a developing roller is weak as compared with the case that the volume average particle size of the resin-coated carrier 2 is 10 μm or more, and carrier adhesion which is a phenomenon that the resin-coated carrier is developed together with the toner 3 occurs in a developing step. Where the volume average particle size of the resin-coated carrier 2 exceeds 100 μm, individual toner particles may not sufficiently be charged.

The volume average particle size of the resin-coated carrier 2 can be measured as follows.

About 10 to 15 mg of the resin-coated carrier 2 is added to 10 ml of a solution of a 5% EMULGEN 109P (polyoxyethylene lauryl ether, HLB 13.6, manufactured by Rao Corporation), and dispersed by an ultrasonic disperser for 1 minute. About 1 ml of the resulting dispersion is added to a given place of MICROTRAC MT3000 (trade name, manufactured by Nikkiso Co., Ltd.), followed by stirring for 1 minute. After confirming that scattering light intensity was stabilized, measurement is conducted.

The resin-coated carrier 2 preferably has a volume resistance of $10^{10}$ Ω·cm or more and $10^{14}$ Ω·cm or less. Where the volume resistance of the resin-coated carrier is less than $10^{10}$ Ω·cm, charge injection is liable to occur to the resin-coated carrier from a developing sleeve, and intensity of development electric field (electric field intensity) becomes too high. As a result, carrier adhesion to the image bearing member occurs. Where the volume resistance of the resin-coated carrier exceeds $10^{14}$ Ω·cm, influence of carrier adhesion to the image bearing member is small, but on the other hand, electric field intensity between a photoreceptor and the developing sleeve becomes weak, an image cannot be developed in detail, and fine line reproducibility of the image obtained is decreased. When the volume resistance of the resin-coated carrier is $10^{10}$ Ω·cm or more and $10^{14}$ Ω·cm or less, the carrier adhesion to the image bearing member can be reduced, and an image can be developed in detail. As a result, a high definition image can be formed.

Development electric field between the image bearing member and the developing sleeve is determined by a distance between carrier particles and a photoreceptor and a volume resistance of a resin-coated carrier in the case that the volume resistance of the resin-coated carrier is relatively low, and is determined by a distance and resistance between the developing sleeve and the photoreceptor in the case that the volume resistance of the resin-coated carrier is relatively high. When the volume resistance of the resin-coated carrier is relatively low, current flows through carrier particles. The carrier particles act as an electrode, and the same potential as a surface potential of the developing sleeve is formed at a tip portion of the carrier particle. As a result, a gap between the developing sleeve and the photoreceptor becomes like narrowing, and development electric field is increased. When the volume resistance of the resin-coated carrier is relatively high, the carrier particles do not act as an electrode, and a surface potential of the developing sleeve is not formed at a tip of a carrier particle layer. As a result, real development electric field is electric field intensity formed in the gap between the development sleeve and the photoreceptor. A toner is easily developed as electric field intensity is high (development gradient is strong).

The volume resistance of the resin-coated carrier 2 can be controlled by containing, for example, conductive particles as a conductive agent in the resin coating layer 2*b*.

For example, conductive carbon black and oxides such as conductive titanium oxide and tin oxide are used as the conductive particles. To develop conductivity in a small addition amount, carbon black or the like is preferred, but there may be the case to a color toner that carbon possibly eliminates from the resin coating layer 2*b* of the resin-coated carrier 2. In this case, for example, conductive titanium oxide having antimony doped therein is used.

In the case of using a silicone resin as the coating resin, a coupling agent is preferably dispersed in the silicone resin. A silicone resin has small surface energy. Therefore, when the silicone resin is used as the coating resin and the silicone resin is contained in the resin coating layer 2*b*, releasability between the toner 3 and the resin-coated carrier 2 can be increased. However, the silicone resin is relatively poor in adhesion to the carrier core material 2*a*. Therefore, when the coupling agent is dispersed in the silicone resin and the resin is contained in the resin coating layer 2*b*, bonding force between the carrier core material 2*a* and the resin coating layer 2*b* can be increased. As a result, releasability between the toner 3 and the resin-coated carrier 2, and adhesion between the carrier core material 2*a* and the resin coating layer 2*b* can be achieved together. The coupling agent includes a silane coupling agent.

When the silane coupling agent is contained in the resin coating layer 2*b*, the silicone resin can uniformly be applied to the carrier core material 2*a*. When a silane coupling agent having an electron-donating functional group is used, the charge amount of the toner 3 can be stabilized. Specific example of the silane coupling agent is an amino group-containing silane coupling agent. As the amino group-containing silane coupling agent, the conventional coupling agents, for example, a compound represented by the following formula (A) can be used:

$$(Y)_n Si(R)_m \quad (A)$$

wherein m pieces of R are the same or different from each other and represent alkyl group, alkoxy group or chlorine atom, n pieces of Y are the same or different from each other and represent an amino group-containing hydrocarbon group, and m and n each represent an integer of 1 to 3, provided that m+n=4.

In the above formula (A), examples of the alkyl group represented by R include linear or branched chain alkyl groups having 1 to 4 carbon number, such as methyl group, ethyl group, propyl group, isopropyl group, butyl group and tert-butyl group. Among them, methyl group and ethyl group are preferred. Examples of the alkoxy group include linear or branched chain alkoxy groups having 1 to 4 carbon number, such as methoxy group, ethoxy group, propoxy group, isopropoxy group, butoxy group, isobutoxy group and tert-butoxy group. Among them, methoxy group and ethoxy group are preferred.

Examples of the amino group-containing hydrocarbon group represented by Y include $—(CH_2)_a—X$ wherein X represents amino group, aminocarbonylamino group, aminoalkyl amino group, phenyl amino group or dialkyl amino group, and a is an integer of from 1 to 4, and -Ph-X wherein X is the same as defined above, and -Ph- represents phenylene group.

Specific examples of the amino group-containing silane coupling agent include the following compounds:

$H_2N(H_2C)_3Si(OCH_3)_3$ $H_2N(H_2C)_3Si(OC_2H_5)_3$ $H_2N(H_2C)_3Si(CH_3)(OCH_3)_2$ $H_2N(H_2C)_2HN(H_2C)_3Si(CH_3)(OCH_3)_2$ $H_2NOCHN(H_2C)_3Si(OC_2H_5)_3$ $H_2N(H_2C)_2HN(H_2C)_3Si(OCH_3)_3$ $H_2N$-Ph-$Si(OCH_3)_3$ wherein -Ph- represents p-phenylene group, Ph-$HN(H_2C)_3Si(OCH_3)_3$ wherein Ph- represents phenyl group $(H_9C_4)_2N(H_2C)_3Si(OCH_3)_3$ The amino group-containing silane coupling agents may be used each alone, or two or more of them may be used in combination. The amount of the amino group-containing silane coupling agent used is appropriately selected from a range that imparts sufficient charge to the toner 3 and does not remarkably decrease mechanical strength and the like of the resin coating layer 2*b*. The amount is preferably 10 parts by weight or less, and further preferably from 0.01 to 10 parts by weight, based on 100 parts by weight of the coating resin.

In the case that the resin coating layer 2*b* contains a silicone resin, the resin coating layer 2*b* can contain other resin in a range of not impairing preferable characteristics of the resin coating layer 2*b* formed by a silicone resin (particularly, cross-linked silicone resin), together with the silicone resin. Examples of the other resin include epoxy resin, urethane resin, phenol resin, acrylic resin, styrene resin, polyamide, polyester, acetal resin, polycarbonate, vinyl chloride resin, vinyl acetate resin, cellulose resin, polyolefin, their copolymer resins and their compounded resins.

The resin coating layer 2*b* may contain a bifunctional silicon oil in order to further improve moisture resistance and releasability of the resin coating layer 2*b* formed by a silicone resin (particularly, cross-linked type silicone resin).

The resin-coated carrier 2 is preferably a spherical shape. However, even though the shape is non-spherical, the effect of the invention is not lost.

Magnetization intensity (maximum magnetization) of the resin-coated carrier 2 is preferably 10 emu/g to 60 emu/g and more preferably 15 emu/g to 40 emu/g. Under the condition of magnetic flux density of an ordinary developing roller, no magnetic binding force works on the carrier having magnetization intensity less than 10 emu/g, which may cause the carrier to scatter. The carrier having magnetization intensity more than 60 emu/g has bushes which are too large to keep the non-contact state of the toner with an image bearing member in a non-contact development. Further, sweeping streaks may be easily appeared on a toner image in a contact development.

(Production Method of Resin-coated Carrier)

The carrier core material 2*a* contained in the resin-coated carrier 2 can be prepared by, for example, a resin addition method and a silica particle addition method. A production method of the resin-coated carrier 2 using the resin addition method includes a weighing step, a mixing step, a pulverization step, a granulation step, a calcination step, a firing step, a crushing step, a classification step and a coating step. A production method of the resin-coated carrier 2 using the silica particle addition method includes a weighing step, mixing step, a pulverization step, a granulation step, a firing step, a crushing step, a classification step and a coating step.

The production method of the resin-coated carrier 2 using a resin addition method is described below.

[Weighing Step and Mixing Step]

At those steps, raw materials of the carrier core material 2*a*, such as magnetic oxide, are weighed, and mixed to obtain a metal raw material mixture. In the case of using two or more of magnetic oxides, those magnetic oxides are weighed such that blending ratio of two or more of magnetic oxides matches the desired component of magnetic oxide.

Next, resin particles are added to the metal raw material mixture. The resin particles added include carbon-based resin particles such as polyethylene and acrylic resin, and resin particles containing silicone such as silicone resin (hereinafter referred to as "silicone-based resin particles"). The carbon-based resin particles and the silicone-based resin particles are the same in that those particles are burned at the calcination step described hereinafter, and a hollow structure is formed in a calcined powder by a gas generated during burning. The carbon-based resin particles merely form a hollow structure during calcination, but the silicone-based resin particles become $SiO_2$ after burning, and remain in a hollow structure formed.

Regarding a volume average particle size and an addition amount of the resin particles, the carbon-based resin particles and the silicone-based resin particles each have the volume average particle size of preferably 2 μm or more and 8 μm or less, and are added in an amount of preferably 0.1% by weight or above and 20% by weight or below, and most preferably 12% by weight, based on the total weight of raw materials of the carrier core material. Note that, the apparent density of the carrier core material 2*a* can be adjusted by the addition amounts of the carbon-based resin particles and the silicone-based resin particles.

[Pulverization Step]

At this step, the metal raw material mixture and the resin particles are introduced into a pulverizer such as a vibration mill, and are pulverized to a volume average particle size of 0.5 to 2.0 μm, and preferably 1 μm. Next, Water, 0.5 to 2% by weight of a binder and 0.5 to 2% by weight of a dispersing agent are added to the pulverized material to form a slurry having a solid content concentration of 50 to 90% by weight. The slurry is wet-pulverized with a ball mill or the like. The binder used here is preferably polyvinyl alcohol, and the dispersing agent used here is preferably ammonium polycarbonate.

[Granulation Step]

At this step, the slurry wet-pulverized is introduced into a spraying drier, and sprayed in hot air of 100 to 300° C. to dry the slurry. Thus, a granulated powder having a volume average particle size of 10 to 200 μm is obtained. Considering a volume average particle size of the resin-coated carrier 2 produced by the present production method, the particle size of the granulated powder obtained is controlled by removing coarse particles and fine particles outside the above range of the volume average particle size by a vibration sieve. Specifically, since the volume average particle size of the resin-coated carrier 7 is preferably 25 μm or more and 50 μm or less, it is preferred that the volume average particle size of the granulated powder is controlled to 15 to 100 μm.

[Calcination Step]

At this step, the granulated powder is introduced into a furnace heated to from 800° C. to 1000° C., and calcined in the atmosphere to obtain a calcined product. In this case, a hollow structure is formed in the granulated powder by a gas generated by burning the resin particles. In the case where the silicone-based resin particles are used as the resin particles, $SiO_2$ which is non-magnetic oxide is formed in the hollow structure.

[Firing Step]

At this step, the calcined product having the hollow structure formed therein is introduced into a furnace heated to 1100 to 1250° C. and burned to form ferrite. Thus, a fired product is obtained. Where the temperature at the time of the firing is high, oxidation of iron proceeds and magnetic force is decreased. Therefore, the remanent magnetization of the carrier core material 2*a* can be adjusted by, for example, firing temperature. Atmosphere during the firing is appropriately selected depending on the kind of metal raw materials such as magnetic oxide, of raw materials of the carrier core material 2*a*. For example, in the case where the metal raw materials are Fe and Mn (molar ratio: 100:0 to 50:50), nitrogen atmosphere is required. In the case where the metal raw materials are Fe, Mn and Mg, nitrogen atmosphere and oxygen partial pressure controlled atmosphere are preferred. In the case where the metal raw materials are Fe, Mn and Mg and the molar ratio of Mg exceeds 30%, air atmosphere may be used.

[Crushing Step and Classification Step]

At those steps, the fired product obtained at the firing step is coarsely crushed with hammer mill crushing or the like, and then subjected to primary classification with an air classifier. Further, after making a particle size uniform with a vibration sieve or an ultrasonic wave sieve, the particles are put in a magnetic field concentrator to remove a non-magnetic component. Thus, a carrier core material 2*a* is obtained.

[Coating Step]

At this step, resin coating is applied to the carrier core material 2*a* obtained in the classification step to form a resin coating layer 2*b* on the surface of the carrier core material 2*a*. Thus, a resin-coated carrier 2 is obtained. A method of forming the resin coating layer 2*b* on the surface of the carrier core material 2*a* includes an immersion method of impregnating the carrier core material 2*a* with a coating resin solution, a spray method of spraying a coating resin solution to the carrier core material 2*a*, and a fluidized-bed method of atomizing a coating resin solution to the carrier core material 2*a* in a floated state by a fluidizing air flow. Among them, the immersion method is preferred in that the resin coating layer 2*a* can easily be formed. The coating resin solution is applied to the surface of the carrier core material 2*a* to form a coating layer, an organic solvent is volatilized and removed from the coating layer by heating, and the coating layer is heat-cured or simply cured during drying or after drying, thereby forming the resin coating layer 2*b*. Thus, the resin-coated carrier 2 is obtained.

The coating resin solution can be prepared by, for example, dissolving the coating resin in an organic solvent. The organic solvent is not particularly limited so long as it can dissolve the coating resin. Examples of the organic solvent include aromatic hydrocarbons such as toluene and xylene; ketones such as acetone and methyl ethyl ketone; ethers such as tetrahydrofuran and dioxane; higher alcohols; and mixed solvents of two or more of them.

The total solid concentration of the coating resin solution is not particularly limited, and is adjusted such that the resin coating layer 2*b* after curing has a film thickness of generally 5 μm or less, and preferably about 0.1 to 3 μm, considering coating workability to the carrier core material 2*a*.

The coating resin solution can be prepared by mixing appropriate amounts of the above-described conductive particles, amino group-containing silane coupling agent, resins other than the coating resin, and additives such as a bifunctional silicone oil, in addition to the coating resin and the organic solvent. For example, in the case of adding conductive particles to a coating resin solution to adjust a volume resistance of the resin-coated carrier 2, the amount of the conductive particles added is preferably 3% by weight or above and 8% by weight or below based on the total weight of solid components contained in the coating resin solution.

Drying of the coated layer may use a dry accelerator. The dry accelerator can use the conventional dry accelerators, and examples thereof include metallic soaps such as lead, iron, cobalt, manganese and zinc salts of naphthylic acid and octylic acid and organic amines such as ethanolamine. The dry accelerators may be used each alone, or two or more of them may be used in combination.

Curing of the coated layer is conducted while selecting a heating temperature according to the kind of the coating resin. For example, the curing is preferably conducted by heating at about 150 to 280° C. In the case that a silicone resin is a room temperature curing type silicone resin, heating is not necessary. However, the coated layer may be heated at about 150 to 280° C. for the purpose of improving mechanical strength of a resin coating layer formed and shortening a curing time.

Production method of the resin-coated carrier using a silica particle addition method is described below.

[Weighing Step and Mixing Step]

At those steps, a metal raw material mixture is obtained in the same manner as in the weighing step of the resin addition method, and silica particles are added to the metal raw material mixture. The silica particles do not burn to generate a gas, differing from the resin particles described in the resin addition method, but are incorporated into a fired product ferritized, in the firing step described hereinafter. For this reason, the fired product having the silica particles incorporated therein has the structure similar to a "fired product having residual $SiO_2$ in hollow structure" described in the resin addition method.

The silica particles have a volume average particle size of preferably 1 to 10 μm. The silica particles are added in an amount of preferably from 1 to 50% by weight based on the total weight of all raw materials of the carrier core material 2*a*. This range provides the following advantages. In the carrier core material obtained through the subsequent steps, when A represents a ratio of an apparent density to a true density in the carrier core material 2*a* is apparent density/true density, $0.25 \leq A \leq 0.40$ is satisfied, and the apparent density is 2.10 g/cm$^3$ or less. Furthermore, the silica particles do not adversely affect electrophotographic development by a two-component developer produced using the carrier core material.

[Pulverization Step and Granulation Step]

Those steps are the same as the pulverization step and granulation step in the resin addition method.

[Firing Step]

The mixed granulated product made of the metal raw material mixture and the silica particles is introduced into a furnace heated to 1,100 to 1,250° C., fired and ferritized. Thus, a fired product is obtained. Atmosphere during the firing is the same as in the resin addition method. A fired product containing silica particles is obtained by the firing.

[Crushing Step, Classification Step and Coating Step]

Those steps are the same as the crushing step, classification step and coating step in the resin addition method. The resin-coated carrier 2 can be produced through those steps.

(3) Two-component Developer

The two-component developer 1 is produced by mixing the toner 3 and the resin-coated carrier 2. The mixing ratio of the toner 3 and the resin-coated carrier 2 is not particularly limited. However, considering to use in a high-speed image forming apparatus (40 sheets/min or more in an image of A4 size), the percentage of total projection area of the toner 3 (the sum of projection areas of whole toner particles) to total projection area of the resin-coated carrier 2 (the sum of surface areas of whole resin-coated carrier particles), ((total projection area of toner 3/total surface area of resin-coated carrier 2)×100), is from 30 to 70% in the state that (volume average particle size of resin-coated carrier 2/volume average particle size of toner 3) is 5 or more. By this, charging property of the toner 3 is stably maintained in sufficiently good state, and the two-component developer 1 can be used as a preferable developer that can stably form a high quality image over a long period of time even in a high-speed image forming apparatus.

For example, when the volume average particle size of the toner is 6.5 μm, the volume average particle size the resin-coated carrier is 50 μm, and the percentage of the total projection area of the toner to the total surface area of the resin-coated carrier is from 30 to 70%, the two-component developer contains the toner in an amount of from about 2.2 to 5.3 parts by weight based on 100 parts by weight of the resin-coated carrier. When a high-speed development is conducted using such a two-component developer, the amount of toner consumed and the amount of toner supplied to a development tank of a developing device according to the consumption of the toner become maximum, respectively, and even in this case, the demand-supply balance is not impaired. Where the amount of the resin-coated carrier in the two-component developer is larger than about 2.2 to 5.3 parts by weight, the charge amount tends to be further decreased. Not only the desired development characteristics are not obtained, but the toner consumption amount is larger than the toner supply amount. As a result, sufficient charge cannot be imparted to the toner, resulting in deterioration of image quality. On the other hand, in the case that the amount of the resin-coated carrier is small, the charge amount tends to be increased, and the toner is difficult to separate from the resin-coated carrier by electric field, resulting in deterioration of image quality.

In the embodiment, the total projection area of the toner 3 is calculated as follows. Specific gravity of the toner 3 is considered 1.0, and the total projection area is calculated on the basis of a volume average particle size obtained by a Coulter counter (trade name: Coulter Counter Multisizer II, manufactured by Beckman Coulter, Inc.) Specifically, the number of toners to a weight of toners mixed is calculated, and (the number of toners)×(toner area, calculated assuming as a circle) is considered as total projection area of toners. Similarly, total surface area of the resin-coated carrier 2 is calculated from a weight of resin-coated carriers mixed on the basis of a particle size obtained by MICROTRAC (trade name: MICROTRAC MT3000, manufactured by Nikkiso Co., Ltd.) Specific gravity of the resin-coated carrier 2 in this case is considered 3.7. Mixing ratio is calculated by the above-obtained (total projection area of toner 3/total surface area of resin-coated carrier 2)×100.

In the two-component developer of the embodiment, the exposure rate of the release agent on the toner 3 surface and the apparent density of the carrier core material 2*a* are set so as to satisfy the following formula (1):

$$y \leq -1.54x - 5.93 \quad (1)$$

wherein y represents the exposure rate of the release agent on the toner 3 surface, and x represents the apparent density of the carrier core material 2*a*.

The two-component developer 1 that the exposure rate of the release agent and the apparent density of the carrier core material 2*a* satisfy the formula (1) becomes a two-component developer 1 having excellent fluidity. For example, in the case of using the toner 3 having relatively large exposure rate of the release agent, a resin-coated carrier 2 in which the apparent density of the carrier core material is relatively small is used. This can reduce driving torque of a stirring screw which stirs the two-component developer 1 and can form a two-component developer 1 having excellent fluidity. In the case of using a resin-coated carrier 2 having relatively large apparent density of the carrier core material, a toner 3 having relatively small exposure rate of the release agent is used. This can reduce adhesion force between the toner 3 and the resin-coated carrier 2 and can form a two-component developer having excellent fluidity. Thus, when a two-component developer having excellent fluidity is used, the toner 3 can stably be charged, and a high quality image can stably be formed over a long period of time.

The formula (1) can be obtained as follow.

A plurality of two-component developers is prepared using a plurality of resin-coated carriers having different apparent density of a carrier core material, and Carrier adhesion is evaluated. Evaluation method of carrier adhesion and evaluation standard are described in the examples described hereinafter.

An apparent density of a carrier core material is shown in x axis, a exposure rate of the release agent on a toner surface is shown in y axis, and evaluation results of carrier adhesion are plotted. Where the apparent density of a carrier core material is too small, carrier adhesion occurs. Therefore, a boundary between a region of good carrier adhesion and a region of poor carrier adhesion is considered as the lower limit of an apparent density of a carrier care material.

A plurality of two-component developers is prepared using a plurality of toners having different exposure rate of the release agent on a toner surface, and fixability is evaluated. Evaluation method of fixability and evaluation standard are described in the examples described hereinafter.

An apparent density of a carrier core material is shown in x axis, an exposure rate of the release agent on a toner surface is shown in y axis, and evaluation results of fixability are plotted. Where the exposure rate of the release agent on a toner surface is too small, poor fixation occurs. Therefore, a boundary between a region of good fixability and a region of poor fixability is considered as the lower limit of an exposure rate of the release agent on a toner surface.

A plurality of two-component developers is prepared using a plurality of toners having different exposure rate of the release agent on a toner surface and a plurality of resin-coated carrier having different apparent density of a carrier core material, and developer fluidity is evaluated. Evaluation method of developer fluidity and evaluation standard are described in the examples described hereinafter.

An apparent density of a carrier core material is shown in x axis, an exposure rate of the release agent on a toner surface is shown in y axis, and evaluation results of developer fluidity are plotted. The developer fluidity is decreased as the apparent density of a carrier core material is increased. Therefore, a region in which the evaluation result of developer fluidity is poor is considered as the upper limit of an apparent density of a carrier core material even though the exposure rate of the release agent on a toner surface is any value.

A point in the vicinity of the boundary between a region of good developer fluidity and a region of poor developer fluidity at the lower limit of the apparent density of a carrier core material is considered as the upper limit of the exposure rate of the release agent on a toner surface. A line connecting this point and a point in the vicinity of the boundary between a region of good developer fluidity and a region of poor developer fluidity at the upper limit of the apparent density of a carrier core material is drawn, and the formula (1) is derived from the line.

As described before, the toner 3 constituting the two-component developer 1 has the exposure rate of the release agent on the toner 3 surface of 1.00% or above and 3.07% or below, and the carrier core material 2*a* has the apparent density of 1.86 g/cm$^3$ or more and 2.45 g/cm$^3$ or less. Furthermore, the two-component developer 1 satisfies the formula (1) obtained above. Due to those requirements, the two-component developer 1 of the embodiment has good fixability and carrier adhesion, and has excellent fluidity.

2. Developing Device

Figure 2:
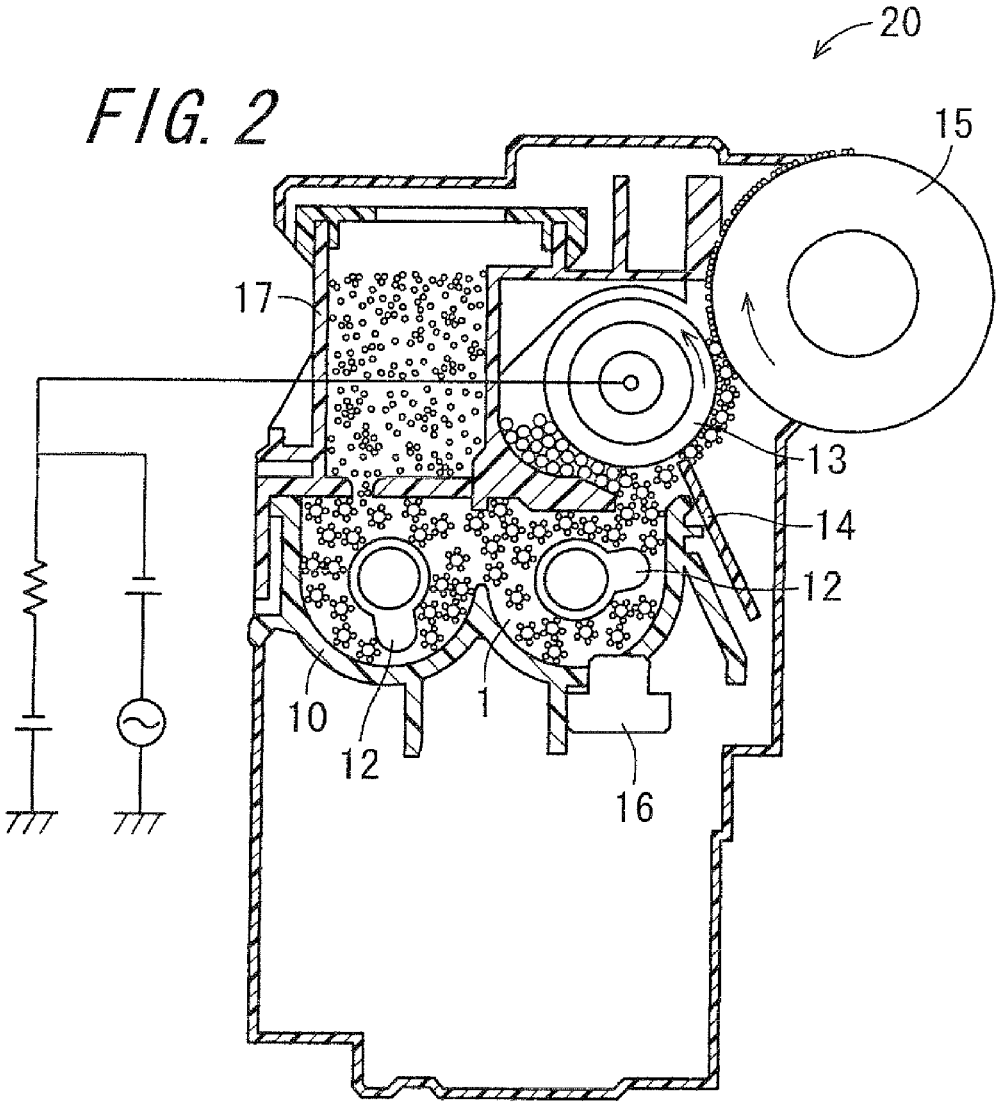
FIG. 2 is a cross-sectional view schematically showing a structure of a developing device according to a second embodiment of the invention.

A developing device 20 according to a second embodiment of the invention conducts development using the above-described two-component developer 1. FIG. 2 is a cross-sectional view schematically showing a structure of the developing device 20 according to the second embodiment of the invention. As shown in FIG. 2, the developing device 20 comprises a developing unit 10 containing the two-component developer 1 therein, and a developer bearing member (developer transporting and bearing member) 13 transporting the two-component developer 1 to an image bearing member (image forming member, photoreceptor) 15.

The two-component developer 1 previously introduced in the inside of the developing unit 10 is stirred with a stirring screw 12, and the two-component developer 1 is charged. The two-component developer 1 is transported the developer bearing member 13 having a magnetic field generating section (not shown) arranged therein, and held on the surface of the developer bearing member 13. The two-component developer 1 held on the surface of the developer bearing member 13 is adjusted to a constant layer thickness by a developer regulating member 14, and transported to a development region formed on an adjacent region between the developer bearing member 13 and an image bearing member 15. Alternate current bias is applied to the two-component developer transported to the development region, and an electrostatic charge image on the image bearing member 15 is developed with a reversal development method. As a result, a visual image is formed on the image bearing member 15.

Consumption of a toner by visual image formation is detected as a change of toner density which is a toner weight ratio to a weight of a two-component developer by a toner density sensor 16. The consumed portion is replenished from a toner hopper 17 until the toner density sensor 16 detects that a toner density reaches a previously determined specified toner density. As a result, a toner density in the two-component developer 1 in the inside of the developing unit 10 is maintained nearly constant. In the embodiment, a gap between the developer bearing member 13 and the developer regulating member 14, and a gap between the developer bearing member 13 and the image bearing member 15 in the development region are set to be, for example, 0.4 mm. However, this value is merely an exemplification, and the gap is not limited to this numerical value. Thus, the developing device 20 of the embodiment develops an electrostatic latent image formed on an image bearing member using the two-component developer 1 of the invention and forms a toner image. As a result, development of an electrostatic latent image can be conducted with a toner having stable charge amount, and a high definition toner image free of fogging can stably be formed over a long period of time.

3. Image Forming Apparatus

An image forming apparatus according to a third embodiment of the invention includes the above-mentioned developing device 20. As other structures, other structures similar to those of a known electrophotographic image forming apparatus are applicable, for example, including an image bearing member, a charging section, an exposure section, a transfer section, a fixing section, an image bearing member cleaning section, and an intermediate transfer member cleaning section.

The image bearing member has a photosensitive layer capable of forming an electrostatic charge image on a surface thereof. The charging section charges an image bearing member surface to a given potential. The exposure section irradiates the image bearing member having the surface in a charged state with signal light corresponding to image information to so as to form an electrostatic charge image (electrostatic latent image) on the surface of the image bearing member. The transfer section includes an intermediate transfer member onto which a toner image formed on the image bearing member is primarily transferred. The transfer section primarily transfers a toner image on the surface of the image bearing member developed by feeding the toner 3 from the developing device 20 to the intermediate transfer member, and then secondarily transfers the toner image to a recoding medium. The fixing section fixes the toner image on the surface of the recording medium to the recording medium. By this, a monochrome image or a multicolor image based on the toner image is formed on the recording medium. The image bearing member cleaning section removes a toner and a paper powder remained on the surface of the image bearing member after transferring the toner image to the recording medium. The intermediate transfer member cleaning section removes superfluous toner and the like adhered to the intermediate transfer member.

Thus, the image forming apparatus of the embodiment comprises the developing device 20 and the transfer section equipped with the intermediate transfer member. The developing device 20 can stably form a high definition toner image free of fogging over a long period of time. Therefore, even in the image forming apparatus of the invention equipped with the intermediate transfer member and having a mechanism of transferring a toner image two times, a high quality image that reproduces an image in high definition, has good color reproducibility and high image density, and is free of image defects such as fogging can stably be formed over a long period of time.

4. Image Forming Method

An image forming method according to a forth embodiment of the invention is performed by using the image forming apparatus of the invention comprising the developing device 20 of the invention.

In developing an electrostatic charge image, a development step visualizing an electrostatic charge image on the image bearing member 15 by reversal development is performed with each color of a toner, and a multicolor toner image is formed on the intermediate transfer member by overlaying a plurality of toner images having different colors on top of each other. The above-described two-component developer 1 is that the charge amount of toner is stabilized over a long period of time, and therefore, can stably form a high definition and high image density multicolor image having excellent image reproducibility including color reproducibility over a long period of time.

The embodiment employs intermediate transfer using an intermediate transfer member, but may use a constitution of directly transferring a toner image to a recording medium from an image bearing member. When the above-described two-component developer 1 is used, the charge amount of toner is stabilized over a long period of time. Therefore, even in the image forming method of the embodiment which transfers a toner image two times using intermediate transfer, a high quality image that reproduces an image in high definition, has good color reproducibility and high image density, and is free of image defects such as fogging can stably be formed over a long period of time.

EXAMPLES

Examples according to the invention and comparative examples are described hereinafter, but the invention is not limited to those examples so long as it is not beyond the gist of the invention.

[Volume Average Particle Size of Toner]

In a 100 mL beaker, 20 mL of an aqueous solution (electrolyte solution) having 1% sodium chloride (primary) was put, and to the solution, 0.5 mL of an alkyl benzene sulfonate (dispersing agent) and 3 mg of a toner sample were successively added, then the mixture was dispersed ultrasonically for 5 minutes. The aqueous solution having 1% sodium chloride (primary) was added to the mixture so that the total amount was 100 mL, the resultant mixture was ultrasonically dispersed for 5 minutes again to thereby obtain a measurement sample. With respect to the measurement sample, the volume average particle size was calculated by Coulter Counter Multisizer II (product name, manufactured by Beckman Coulter, Inc.) under the conditions that the aperture diameter was 100 μm and that the particle size to be measured was 2 to 40 μm for each particle.

[Total Projection Area of Toner]

Specific gravity of a toner was considered 1.0, and the number of toners to a weight of toners to be mixed was calculated on the basis of a volume average particle size obtained by a Coulter counter (trade name: Coulter Counter Multisizer II, manufactured by Beckman Coulter, Inc.), and (the number of toner)×(toner area, calculated assuming as a circle) was considered as the total projection area of toner.

[Exposure Rate of Release Agent]

In 20 ml of hexane, 1 g of a toner was dispersed. The resulting dispersion was stirred with a stirrer for 10 minutes, thereby eluting a release agent on a toner surface in hexane. Thereafter, filtration was conducted, and the toner elution-treated with hexane was placed in a dryer at 40° C. overnight, and dried. The toner of 1 g was heated from a temperature of 20° C. to 150° C. in a temperature-rising rate of 10° C./minute, and then rapidly cooled from 150° C. to 20° C. This operation was repeated two times, and a DSC curve was obtained. Heat capacity of the release agent in the toner was calculated by fusion heat quantity of the DSC curve measured by the second operation. Regarding untreated toner, heat capacity of the release agent in the toner was calculated in the same manner. The exposure rate of the release agent was estimated from the difference of those heat capacities.

[Dispersion Diameter of Release Agent on Toner Surface]

In a 2 L beaker, 100 parts of n-hexane (manufactured by Kishida Chemical Co., Ltd.) and a stirring bar were placed, and 5 parts by weight of a toner is placed in the beaker while stirring with a stirrer. An ultrasonic vibration bar was dipped in the beaker, and stirring was conducted for 10 seconds while vibrating the bar at 28 kHz. Thus, a release agent exposed on the surface of toner particles was removed. Thereafter, the dispersion in the beaker, having toner particles dispersed therein was suction filtered, and toner particles remained on a filter paper were dried in a constant temperature and humidity chamber of a temperature of 35° C. and a humidity of 5% RH. A metal film (Au film, thickness: 0.5 μm) was formed on the surface of the dried toner particles by sputter deposition. Using a scanning electron microscope (trade name: VE9800, manufactured by Keyence Corporation), 200 to 300 of holes after removing release agents were randomly extracted from the metal film-coated toner having a metal film formed thereon at an accelerating voltage of 10 kV and 1,000-fold magnification, and a photo shoot was conducted. The pieces of electron microphotograph data were image-analyzed with an image analyzing software (trade name: A-ZO-KUN, manufactured by Asahi Kasei Engineering Corporation), and an average diameter of 200 to 300 of holes after removing release agents randomly selected was obtained. Thus, a dispersion diameter of a release agent on a toner surface was obtained.

[Apparent Density of Carrier Core Material]

An apparent density of a carrier core material was measured according to JIS 22504 (2000).

[Remanent Magnetization of Carrier Core Material]

A vibrating sample type magnetometer (trade name: VSM, manufactured by Toei Industry Co., Ltd.) was used for remanent magnetization of a carrier core material. A carrier core material is charged in a plastic container (circular) having a diameter of 6 mm without space, and remanent magnetization was measured by changing an external magnetic field.

[Volume Average Particle Size of Carrier Core Material]

A volume average particle size of a carrier core material was measured using a particle size distribution measurement equipment MICROTRAC MT3000 (manufactured by Nikkiso Co., Ltd.) using a laser diffraction and scattering method. About 1 to 5 mg of a measurement sample was added to 10 ml of 0.1% pure water solution of TRITON X-100 (nonionic surfactant (chemical formula: $C_{34}H_{62}O_{11}$)), and dispersed therein with an ultrasonic disperser for 1 minute. About 2 to 5 ml of the dispersion was added to a given portion of the particle, size distribution measurement equipment, and stirred for 1 minute. After confirming that scattering light intensity was stabilized, a volume average particle size of a carrier core material was measured.

[Volume Resistance of Resin-coated Carrier]

A volume resistance of a resin-coated carrier was measured using a bridge resistance measurement jig having a distance between opposing electrodes of 1 mm and a measurement electrode area of 40×16 $mm^2$ under normal temperature and normal humidity environment. Specifically, 0.2 mg of a resin-coated carrier as a measurement sample was weighed by an electron weighing machine or the like, and inserted in a space between the opposing electrodes of the bridge resistance measurement jig. A bridge of the resin-coated carriers was formed between the opposing electrodes using a magnet from the back of the electrodes. In this case, tapping was conducted about 5 to 6 times to average the resin-coated carrier in the bridge. After making the resin-coated carriers in the bridge uniform, current value when applying a voltage at which electric field of $2\times10^3$ (V/cm) is generated was measured using a digital electron meter (trade name: R8340, manufactured by Advantest Corporation), and a volume resistance of the resin-coated carrier was calculated.

[Total Surface Area of Resin-coated Carrier]

Specific gravity of a resin-coated carrier was considered 4.7, and total area was calculated from a weight of the resin-coated carrier to be mixed, on the basis of a volume average particle size obtained by MICROTRAC (trade name: MICROTRAC MT3000, manufactured by Nikkiso Co., Ltd.).

Preparation methods of a toner and a resin-coated carrier contained in two-component developers of examples and comparative examples are described below. Hereinafter, "parts" means "parts by weight".

(Preparation of Toner)

Six kinds of toners (toners (1) to 6)) were prepared as follows.

[Toner (1)]

Binder resin: Polyester resin (acid value: 21 mg KOH/g, aromatic alcohol component: PO-BPA and EP-EPA, acid component: fumaric acid and mellitic anhydride)

. . . 87.5% by weight

Colorant: C.I. Pigment Blue 15:1 . . . 5% by weight

Release agent: non-polar paraffin wax (DSC peak: 78° C., weight average molecular weight Mw: $8.32\times10^2$)

. . . 4.5% by weight

Charge control agent: BONTRON E-84 (trade name, manufactured by Orient Chemical Industries Co., Ltd.)

. . . 1.5% by weight

The above constituent materials were premixed with a Henschel mixer, and melt-kneaded with a twin-screw extrusion kneading machine. The kneaded material thus melt-kneaded was coarsely pulverized with a cutting mill and then finely pulverized with a jet mill. The resulting particles were classified with a wind classifier. Thus, toner base particles having a volume average particle size of 6.5 μm were prepared.

To 97.8% by weight of the classified toner base particles, 1.2% by weight of silica particles hydrophobicized with i-butyltrimethoxysilane, having a volume average particle size of 0.1 μm and 1.0% by weight of silica particles hydrophobicized with HMDS, having a volume average particle size of 12 nm were added. The resulting mixture was mixed with a Henschel mixer perform an external addition treatment. Thus, a toner (1) was prepared.

[Toners (2) to (6)]

Toners (2) to (6) were prepared in the same manner as the preparation method of the toner (1), except that the amount of the release agent added, and the like were adjusted such that an exposure rate of the release agent and a dispersion diameter of a release agent on a toner surface are the values shown in Table 1. Regarding the toner (6), the amount of the release agent added was changed, and additionally, in premixing with a Henschel mixer, the time of mixing and stirring a release agent only was half. Furthermore, a dispersion diameter of a release agent on a toner surface was larger than that of other toners by adjusting melt-kneading condition time with a twin-screw extrusion kneading machine.

Content of a release agent, exposure rate of the release agent, and dispersion diameter of a release agent on a toner surface, in toners (1) to (6) are shown in Table 1.

TABLE 1

| | Amount of release agent added (% by weight) | Exposure rate of the release agent (%) | Dispersion diameter of release agent (nm) |
|---|---|---|---|
| Toner (1) | 4.5 | 1.21 | 200 |
| Toner (2) | 5.3 | 2.16 | 200 |
| Toner (3) | 6.2 | 3.15 | 285 |
| Toner (4) | 3.0 | 0.75 | 200 |
| Toner (5) | 8.0 | 4.60 | 290 |
| Toner (6) | 5.3 | 2.73 | 315 |

(Preparation of Resin-coated Carrier)

Eighteen kinds of resin-coated carriers (resin-coated carriers (1) to (18)) were prepared as follows.

[Resin-coated Carrier (1)]

Finely pulverized $Fe_2O_3$ and $MgCO_3$ were provided as raw materials of a carrier core material. Those were weighed so as to be $Fe_2O_3$:$MgCO_3$=80:20 in molar ratio. On the other hand, a mixture obtained by adding polyethylene resin particles having a volume average particle size of 5 μm (trade name: LE-1080, manufactured by Sumitomo Seika Chemicals Co., Ltd.), corresponding to 10% by weight based on the weight of all materials of a carrier core material, 1.5% by weight of ammonium polycarbonate type dispersing agent as a dispersing agent, 0.05% by weight of a wetting agent (trade name: SN WET 980, manufactured by San Nopco Limited) and 0.02% by weight of a polyvinyl alcohol as a binder to water was provided. $Fe_2O_3$ and $MgCO_3$ weighed above were introduced into the mixture, followed by stirring. Thus, slurry having a concentration of 75% by weight was obtained.

The slurry was wet-pulverized with a wet ball mill, and stirred for a while. The slurry was sprayed with a spray dryer, thereby obtaining a dry granulated product having a particle size of 10 to 200 μm. Coarse particles were separated from the dry granulated product using a sieve mesh having a mesh opening of 61 μm, and the product thus treated was calcined at 900° C. in the atmosphere to decompose a polyethylene resin particle component. The product was then fired at 1,160° C. for 5 hours in a nitrogen atmosphere, thereby ferritizing. The ferritized fired product was crushed with a hammer mill, fine powder was removed using an air classifier, and particle size was adjusted with a vibration sieve having a mesh opening of 54 μm. Thus, a carrier core material was obtained. The carrier core material had a volume average particle size of 40 μm and an apparent density of 2.01 g/cm$^3$.

Immersion method was used as a method of coating the surface of the carrier core material with a resin.

Coating resin: SR2411 (trade name, silicone resin 20% solution, manufactured by Dow Corning Toray Co., Ltd.)

. . . 100 parts by weight

Coupling agent: SH6020 (trade name, 100% solution, manufactured by Dow Corning Toray Co., Ltd.)

. . . 1 part by weight

Conductive particle: VULCAN XC72 (trade name, conductive carbon black toluene dispersion, solid concentration 15% solution, manufactured by Cabot Corporation) . . . 5 parts by weight Charge control agent: LR-147 (trade name, negatively charged charge control agent, solution, manufactured by Japan Carlit Co., Ltd.) . . . 20 parts by weight The carrier core material was dipped in the coating resin solution prepared with the above compositional ratio, a solvent in the coating resin solution was evaporated while mixing and stirring, and a resin coating layer was formed on the surface of the carrier core material. Thus, a resin-coated carrier (1) was obtained.

[Resin-coated Carrier (2)]

A resin-coated carrier (2) was obtained in the same manner as the preparation method of the resin-coated carrier (1) except that the amount of the polyethylene resin particles added was adjusted such that the apparent density of the carrier core material is 1.8 g/cm$^3$. Measured value of the apparent density of the carrier core material contained in the resin-coated carrier (2) was 1.86 g/cm$^3$.

[Resin-coated Carrier (3)]

A resin-coated carrier (3) was obtained in the same manner as the preparation method of the resin-coated carrier (1) except that the amount of the polyethylene resin particles added was adjusted such that the apparent density of the carrier core material is 2.0 g/cm$^3$. Measured value of the apparent density of the carrier core material contained in the resin-coated carrier (3) was 1.88 g/cm$^3$.

[Resin-coated Carrier (4)]

A resin-coated carrier (4) was obtained in the same manner as the preparation method of the resin-coated carrier (1) except that the amount of the polyethylene resin particles added was adjusted such that the apparent density of the carrier core material is 2.5 g/cm$^3$. Measured value of the apparent density of the carrier core material contained in the resin-coated carrier (4) was 2.45 g/cm$^3$.

[Resin-coated Carrier (5)]

A resin-coated carrier (5) was obtained in the same manner as the preparation method of the resin-coated carrier (1) except that the amount of the polyethylene resin particles added was adjusted such that the apparent density of the carrier core material is 1.5 g/cm$^3$. Measured value of the apparent density of the carrier core material contained in the resin-coated carrier (5) was 1.59 g/cm$^3$.

[Resin-coated Carrier (6)]

A resin-coated carrier (6) was obtained in the same manner as the preparation method of the resin-coated carrier (1) except that the amount of the polyethylene resin particles added was adjusted such that the apparent density of the carrier core material is 2.5 g/cm$^3$. Measured value of the apparent density of the carrier core material contained in the resin-coated carrier (6) was 2.61 g/cm$^3$.

[Resin-coated Carrier (7)]

A resin-coated carrier (7) was obtained in the same manner as the preparation method of the resin-coated carrier (1) except that the preparation conditions of a carrier core material were adjusted such that the volume average particle size of the carrier core material is 25 μm.

[Resin-coated Carrier (8)]

A resin-coated carrier (8) was obtained in the same manner as the preparation method of the resin-coated carrier (1) except that the preparation conditions of a carrier core material were adjusted such that the volume average particle size of the carrier core material is 35 μm.

[Resin-coated Carrier (9)]

A resin-coated carrier (9) was obtained in the same manner as the preparation method of the resin-coated carrier (1) except that the preparation conditions of a carrier core material were adjusted such that the volume average particle size of the carrier core material is 50 μm.

[Resin-coated Carrier (10)]

A resin-coated carrier (10) was obtained in the same manner as the preparation method of the resin-coated carrier (1) except that the preparation conditions of a carrier core material were adjusted such that the volume average particle size of the carrier core material is 20 μm.

[Resin-coated Carrier (11)]

A resin-coated carrier (11) was obtained in the same manner as the preparation method of the resin-coated carrier (1) except that the preparation conditions of a carrier core material were adjusted such that the volume average particle size of the carrier core material is 55 μm.

[Resin-coated Carrier (12)]

A resin-coated carrier (12) was obtained in the same manner as the preparation method of the resin-coated carrier (1) except that the amount of the conductive particles added was changed from 5 parts by weight to 2.5 parts by weight in order to adjust a volume resistance of a resin-coated carrier.

[Resin-coated Carrier (13)]

A resin-coated carrier (13) was obtained in the same manner as the preparation method of the resin-coated carrier (1) except that the amount of the conductive particles added was changed from 5 parts by weight to 7 parts by weight in order to adjust a volume resistance of a resin-coated carrier.

[Resin-coated Carrier (14)]

A resin-coated carrier (14) was obtained in the same manner as the preparation method of the resin-coated carrier (1) except that the amount of the conductive particles added was changed from 5 parts by weight to 2.0 parts by weight in order to adjust a volume resistance of a resin-coated carrier.

[Resin-coated Carrier (15)]

A resin-coated carrier (15) was obtained in the same manner as the preparation method of the resin-coated carrier (1) except that the amount of the conductive particles added was changed from 5 parts by weight to 10 parts by weight in order to adjust a volume resistance of a resin-coated carrier.

[Resin-coated Carrier (16)]

A resin-coated carrier (16) was obtained in the same manner as the preparation method of the resin-coated carrier (1) except that the amount of the conductive particles added was changed from 5 parts by weight to 0.5 parts by weight in order to adjust a volume resistance of a resin-coated carrier.

[Resin-coated Carrier (17)]

A resin-coated carrier (17) was obtained in the same manner as the preparation method of the resin-coated carrier (1) except that the preparation conditions were adjusted such that the apparent density of the carrier core material is 2.10 g/cm$^3$.

[Resin-coated Carrier (18)]

A resin-coated carrier (18) was obtained in the same manner as the preparation method of the resin-coated carrier (1) except that the preparation conditions were adjusted such that the remanent magnetization of the resin-coated carrier core material is 11 emu/g or more.

In the resin-coated carriers (1) to (18), an apparent density of the carrier core material, a volume average particle size of the carrier core material, remanent magnetization of the carrier core material and a volume resistance of the resin-coated carrier are shown in Table 2.

TABLE 2

| | Carrier core material | | | | |
|---|---|---|---|---|---|
| | Apparent density (g/cm$^3$) | Volume average particle size (μm) | Remanent magnetization (emu/g) | Coating resin | Volume resistance (Ω · cm) |
| Resin-coated carrier (1) | 2.01 | 40 | 0.5 | Silicone resin | $10^{12}$ |
| Resin-coated carrier (2) | 1.86 | 40 | 1.0 | Silicone resin | $10^{13}$ |
| Resin-coated carrier (3) | 1.88 | 40 | 6.0 | Silicone resin | $10^{10}$ |
| Resin-coated carrier (4) | 2.45 | 40 | 0.7 | Silicone resin | $10^{10}$ |
| Resin-coated carrier (5) | 1.59 | 40 | 2.8 | Silicone resin | $10^{12}$ |
| Resin-coated carrier (6) | 2.61 | 40 | 1.0 | Silicone resin | $10^{12}$ |
| Resin-coated carrier (7) | 2.05 | 25 | 0.5 | Silicone resin | $10^{12}$ |
| Resin-coated carrier (8) | 2.01 | 35 | 0.5 | Silicone resin | $10^{12}$ |
| Resin-coated carrier (9) | 2.00 | 50 | 0.5 | Silicone resin | $10^{12}$ |
| Resin-coated carrier (10) | 2.10 | 20 | 1.0 | Silicone resin | $10^{12}$ |
| Resin-coated carrier (11) | 1.98 | 55 | 1.0 | Silicone resin | $10^{12}$ |
| Resin-coated carrier (12) | 2.01 | 40 | 0.5 | Silicone resin | $10^{13}$ |
| Resin-coated carrier (13) | 2.01 | 40 | 0.5 | Silicone resin | $10^{10}$ |
| Resin-coated carrier (14) | 2.01 | 40 | 0.5 | Silicone resin | $10^{11}$ |
| Resin-coated carrier (15) | 2.01 | 40 | 0.5 | Silicone resin | $10^{9}$ |
| Resin-coated carrier (16) | 2.01 | 40 | 0.5 | Silicone resin | $10^{15}$ |
| Resin-coated carrier (17) | 2.10 | 40 | 10 | Silicone resin | $10^{11}$ |
| Resin-coated carrier (18) | 2.03 | 42 | 11 | Silicone resin | $10^{13}$ |

Two-component developers of examples and comparative examples were prepared using the toners (1) to (6) and the resin-coated carriers (1) to (18). The combination of the toners (1) to (6) and the resin-coated carriers (1) to (18) in those two-component developers is shown in Table 3.

TABLE 3

| | Toner (1) | Toner (2) | Toner (3) | Toner (4) | Toner (5) | Toner (6) |
|---|---|---|---|---|---|---|
| Resin-coated carrier (1) | Example 1 | Example 5 | Comparative Example 5 | Comparative Example 10 | Comparative Example 16 | Example 10 |
| Resin-coated carrier (2) | Example 2 | Example 6 | Example 9 | Comparative Example 11 | Comparative Example 17 | |
| Resin-coated carrier (3) | Example 3 | Example 7 | Comparative Example 6 | Comparative Example 12 | Comparative Example 18 | |
| Resin-coated carrier (4) | Example 4 | Example 8 | Comparative Example 7 | Comparative Example 13 | Comparative Example 19 | |
| Resin-coated carrier (5) | Comparative Example 1 | Comparative Example 3 | Comparative Example 8 | Comparative Example 14 | Comparative Example 20 | |
| Resin-coated carrier (6) | Comparative Example 2 | Comparative Example 4 | Comparative Example 9 | Comparative Example 15 | Comparative Example 21 | |
| Resin-coated carrier (7) | | Example 11 | | | | |
| Resin-coated carrier (8) | | Example 12 | | | | |
| Resin-coated carrier (9) | | Example 13 | | | | |
| Resin-coated carrier (10) | | Example 14 | | | | |
| Resin-coated carrier (11) | | Example 15 | | | | |
| Resin-coated carrier (12) | | Example 16 | | | | |
| Resin-coated carrier (13) | | Example 17 | | | | |
| Resin-coated carrier (14) | | Example 18 | | | | |
| Resin-coated carrier (15) | | Example 19 | | | | |
| Resin-coated carrier (16) | | Example 20 | | | | |
| Resin-coated carrier (17) | | Example 22 | | | | |
| Resin-coated carrier (18) | | Example 21 | | | | |

Examples 1 to 9

Two-component developers of Examples 1 to 9 were prepared by combining the toners (1) to (5) having a different content of the release agent in a range of 3.0 to 8.0% by weight, and the resin-coated carriers (1) to (4) having a different apparent density in a range of 1.86 to 2.45 g/cm$^3$, respectively. Specifically, a mixing ratio of the toner and the resin-coated carrier was adjusted such that the toner coverage to the resin-coated carrier is 60%, and the mixture was kneaded with a roll mill for 60 minutes.

Comparative Examples 1 to 21

Two-component developers of Comparative Examples 1 to 21 were prepared by combining the toners (1) to (5) having a different content of the release agent in a range of 3.0 to 8.0% by weight, and the resin-coated carriers (1) to (6) having a different apparent density in a range of 1.59 to 2.61 g/cm$^3$, respectively. Specifically, a mixing ratio of the toner and the resin-coated carrier was adjusted such that the toner coverage to the resin-coated carrier is 60%, and the mixture was kneaded with a roll mill for 60 minutes.

Fluidity characteristic, carrier adhesion, fixability and toner charging characteristic of the two-component developers of Examples 1 to 9 and Comparative Examples 1 to 21 were evaluated by the following methods.

[Developer Fluidity]

Using the two-component developers of Examples 1 to 9 and Comparative Examples 1 to 21, respectively, stirring deterioration test by a shaker was conducted, and fluidity of the two-component developer after stirring was measured. Specifically, 15 cc of the two-component developer was introduced into a glass sample bottle (50 cc). To evaluate initial developer fluidity, an angle of rotation at which a powder layer of the two-component developer in the glass sample bottle collapses was measured by a cylinder rotation method using a flow surface angle tester, and the angle was considered as an initial flow initiation angle.

Thereafter, the two-component developer in the glass sample bottle was stirred at a setting frequency of 26.3 Hz for 2 hours using a shaker (trade name: MM200, manufactured by Retsch Co., Ltd.), and a flow initiation angle of the two-component developer after stirring was measured with the flow surface angle tester. Difference ($\Delta\theta$) of the flow initiation angle in the two-component developer before and after stirring is a degree of decrease in fluidity, and fluidity of the two-component developer is decreased as the difference ($\Delta\theta$) of the flow initiation angle is large.

Evaluation standard of developer fluidity is as follows.

Good: Favorable. Difference ($\Delta\theta$) of flow initiation angle is 30° or less.

Not bad: Available. Difference ($\Delta\theta$) of flow initiation angle is larger than 30° and is 60° or less.

Poor: No good. Difference ($\Delta\theta$) of flow initiation angle exceeds 60°.

[Carrier Adhesion]

A digital color copying machine having a two-component developing device trade name: MX-4500, manufactured by Sharp Corporation) was used for the evaluation of carrier adhesion. The two-component developers of Examples 1 to 9 and Comparative Examples 1 to 21 each were introduced into the two-component developing device.

A development cartridge of the two-component developing device and a process cartridge having a photoreceptor drum were set to an exclusive test bench, and false development was conducted using an external high pressure power source. During the development, the process cartridge was stopped, and a resin-coated carrier adhered to the surface of the photoreceptor drum was collected using a mending tape (trade name: 810-3-18, manufactured by Sumitomo 3M Limited). The number of resin-coated carriers per unit area, adhered to the surface of the photoreceptor drum was counted, and carrier adhesion was evaluated by a ratio (F) to the number defined in our company (the number measured/the number defined in our company).

Evaluation standard of the carrier adhesion is as follows.

Good: Favorable. The ratio (F) is less than 0.5.

Not bad: Available. The ratio (F) is 0.5 or more and is less than 1.0

Poor: No good. The ratio (F) is 1.0 or more.

[Fixability]

The two-component developers of Examples 1 to 9 and Comparative Examples 1 to 21 each were charged in a copying machine converted from the copying machine MX-4500. Unfixed image was formed on a recording paper sheet which is a recording medium (trade name: PCP paper SF-4AM3, manufactured by Sharp Corporation) by adjusting such that an adhesion amount of toner to the recording paper sheet in an unfixed state in a solid image area of a sample image is 0.5 mg/cm$^2$, and a fixed image was formed using an external fixing device prepared using a fixing section of a color copying machine. The solid image area of the sample image is a rectangular solid image having 20 mm long and 50 mm wide. Fixing process speed is 124 mm/sec, temperature of a fixing roller is elevated from 130° C. every 5° C., and a fixed non-offset region (° C.) which is a temperature region at which low temperature offset and high temperature offset are not generated was obtained.

Specifically, the fixed non-offset region is calculated by the following formula (B).

(Fixed non-offset region (° C.))=(High temperature offset generation temperature (° C.))−(Low temperature offset generation temperature (° C.)) (B)

In this evaluation, generation of high temperature offset and generation of low temperature offset are defined as that a toner does not fix to a recording paper at the time of fixing, and after a fixing roller having the toner fixed thereto has gone round, the toner is adhered to the recording paper.

Evaluation standard of the fixability is as follows.

Good: Favorable. Fixed non-offset region is 45° C. or higher.

Not bad: Available. Fixed non-offset region is 35° C. or higher and is lower than 45° C.

Poor: No good. Fixed non-offset region is lower than 35° C.

[Toner Charging Characteristic]

To evaluate toner charging characteristic, initial charging property, decay characteristic of charging and life characteristic of charging in the two-component developers of Examples 1 to 9 and Comparative Examples 1 to 21 were evaluated.

(Initial Charging Property)

The two-component developers of Examples 1 to 9 and Comparative Examples 1 to 21 each were set in a copying machine (converted from MX-6200N of Sharp Corporation) having a two-component developing device therein. After the copying machine was run idle for 3 minutes in normal temperature and normal humidity environment, the two-component developers on a developer bearing member (development sleeve) were collected. The charge amount of each of the two-component developers was measured with a suction type charge amount measuring apparatus (trade name: 210H-2A Q/M Meter, manufactured by TREK Inc.)

Evaluation standard of the initial charging property is as follows.

Good: Favorable. Charge amount is −25 μC/g or more.

Not bad: Available. Charge amount is −20 μC/g or more and less than −25 μC/g.

Poor: No good. Charge amount is less than −20 μC/g.

(Decay Characteristic of Charging)

A 100 ml polyethylene container containing a developer comprising 69.6 g of a resin-coated carrier and 6.4 g of a toner therein was stirred with a ball mill at 150 rpm for 60 minutes. The charge amount of the two-component developer was measured, and then exposed to high temperature and high humidity. The two-component developer after allowing to stand for 3 days was stirred under the same conditions, and the charge amount of the two-component developer was measured.

Evaluation standard of environmental characteristic of charge amount is as follows.

Good: Favorable. Difference between charge amount at the first day of two-component developer and charge amount after 3 days (hereinafter referred to as "charge amount difference") is 5 μC/g or less in absolute value.

Not bad: Available. Charge amount difference is more than 5 μC/g and is 7 μC/g or less in absolute value.

Poor: No good. Charge amount difference exceeds 7 μC/g in absolute value.

(Life Characteristic of Charging)

To evaluate life characteristic of charging, life charging property was evaluated. The two-component developers of Examples 1 to 9 and Comparative Examples 1 to 21 each were charged in a copying machine (trade name: MX-6000N, manufactured by Sharp Corporation) having a two-component developing device therein. After a solid image was actually printed 50,000 sheets in normal temperature and normal humidity environment, the charge amount of life of the two-component developer was measured. The charge amount of life of the two-component developer was measured using a suction type charge amount measuring apparatus. The initial charge amount of the two-component developer used the value obtained by the measurement in the evaluation of (Initial charging property) described above.

Evaluation standard of the life charging property is as follows.

Good: Favorable. Difference between initial charge amount and life charge amount (hereinafter referred to as "life charge amount difference") is 5 μC/g or less in absolute value.

Not bad: Available. Life charge amount difference is more than 5 μC/g and is 7 μC/g or less in absolute value.

Poor: No good. Life charge amount difference exceeds 7 μC/g in absolute value.

Evaluation results of the two-component developers of Examples 1 to 9 and Comparative Examples 1 to 21 and comprehensive evaluation results are shown in Table 4.

TABLE 4

| | | | | | | | | | | | Toner charging characteristic | | | |
|---|---|---|---|---|---|---|---|---|---|---|---|---|---|---|
| | | | | | Fixability | | Initial charging | | Decay charcteristic of charging | | Life characteristic of charging | |
| | Kind of carrier | Kind of toner | Developer fluidity Δθ (°) | Evaluation | Carrier adhesion F | Evaluation | Fixed non-offset region (° C.) | Evaluation | Charge amount (μC/g) | Evaluation | Charge amount difference (μC/g) | Evaluation | Charge amount difference (μC/g) | Evaluation |
| Example 1 | Resin-coated carrier (1) | Toner (1) | 20 | Good | | | 40 | Not bad | | | | | | |
| Example 2 | Resin-coated carrier (2) | Toner (1) | 18 | Good | | | | | | | | | | |

TABLE 4-continued

| | Kind of carrier | Kind of toner | Developer fluidity Δθ (°) | Evaluation | Carrier adhesion F | Evaluation | Fixability: Fixed non-offset region (° C.) | Evaluation | Initial charging property: Charge amount (μC/g) | Evaluation | Toner charging characteristic: Decay charcteristic of charging: Charge amount difference (μC/g) | Evaluation | Toner charging characteristic: Life characteristic of charging: Charge amount difference (μC/g) | Evaluation |
|---|---|---|---|---|---|---|---|---|---|---|---|---|---|---|
| Example 3 | Resin-coated carrier (3) | Toner (1) | 20 | Good | | | | | | | | | | |
| Example 4 | Resin-coated carrier (4) | Toner (1) | 25 | Good | | | | | | | | | | |
| Example 5 | Resin-coated carrier (1) | Toner (2) | 24 | Good | 0.25 | Good | 50 | Good | −32 | Good | 3 | Good | 4 | Good |
| Example 6 | Resin-coated carrier (2) | Toner (2) | 20 | Good | 0.40 | Good | | | −36 | Good | 4 | Good | 5 | Good |
| Example 7 | Resin-coated carrier (3) | Toner (2) | 22 | Good | 0.40 | Good | | | −30 | Good | 3 | Good | 4 | Good |
| Example 8 | Resin-coated carrier (4) | Toner (2) | 36 | Not bad | 0.40 | Good | | | −25 | Not bad | 7 | Not bad | 6 | Not bad |
| Example 9 | Resin-coated carrier (2) | Toner (3) | 26 | Good | | | | | | | | | | |
| Comparative Example 1 | Resin-coated carrier (5) | Toner (1) | 22 | Good | 1.40 | Poor | | | −30 | Good | 4 | Good | 7 | Not bad |
| Comparative Example 2 | Resin-coated carrier (6) | Toner (1) | 65 | Poor | 0.20 | Good | | | −40 | Good | 9 | Poor | 20 | Poor |
| Comparative Example 3 | Resin-coated carrier (5) | Toner (2) | 20 | Good | | | | | | | | | | |
| Comparative Example 4 | Resin-coated carrier (6) | Toner (2) | 65 | Poor | | | | | | | | | | |
| Comparative Example 5 | Resin-coated carrier (1) | Toner (3) | 28 | Good | | | 50 | Good | | | | | | |
| Comparative Example 6 | Resin-coated carrier (3) | Toner (3) | 40 | Not bad | | | | | | | | | | |
| Comparative Example 7 | Resin-coated carrier (4) | Toner (3) | 40 | Not bad | | | | | | | | | | |
| Comparative Example 8 | Resin-coated carrier (5) | Toner (3) | 34 | Not bad | | | | | | | | | | |
| Comparative Example 9 | Resin-coated carrier (6) | Toner (3) | 70 | Poor | | | | | | | | | | |
| Comparative Example 10 | Resin-coated carrier (1) | Toner (4) | 20 | Good | | | 30 | Poor | | | | | | |
| Comparative Example 11 | Resin-coated carrier (2) | Toner (4) | 20 | Good | | | | | | | | | | |
| Comparative Example 12 | Resin-coated carrier (3) | Toner (4) | 22 | Good | | | | | | | | | | |
| Comparative Example 13 | Resin-coated carrier (4) | Toner (4) | 24 | Good | | | | | | | | | | |
| Comparative Example 14 | Resin-coated carrier (5) | Toner (4) | 24 | Good | | | | | | | | | | |
| Comparative Example 15 | Resin-coated carrier (6) | Toner (4) | 35 | Not bad | | | | | | | | | | |
| Comparative Example 16 | Resin-coated carrier (1) | Toner (5) | 70 | Poor | | | 50 | Good | | | | | | |
| Comparative Example 17 | Resin-coated carrier (2) | Toner (5) | 45 | Not bad | | | | | | | | | | |
| Comparative Example 18 | Resin-coated carrier (3) | Toner (5) | 70 | Poor | | | | | | | | | | |
| Comparative Example 19 | Resin-coated carrier (4) | Toner (5) | 66 | Poor | | | | | | | | | | |
| Comparative Example 20 | Resin-coated carrier (5) | Toner (5) | 50 | Not bad | | | | | | | | | | |
| Comparative Example 21 | Resin-coated carrier (6) | Toner (5) | 75 | Poor | | | | | | | | | | |

It is seen from the above results that Examples 1 to 9 can sufficiently prevent decrease in fluidity of a two-component developer due to long-term use. It is further seen that carrier adhesion is good in Examples 5 to 8, fixability can be maintained in Examples 1 and 5, and a high quality image of high definition can easily be formed.

Figure 3:
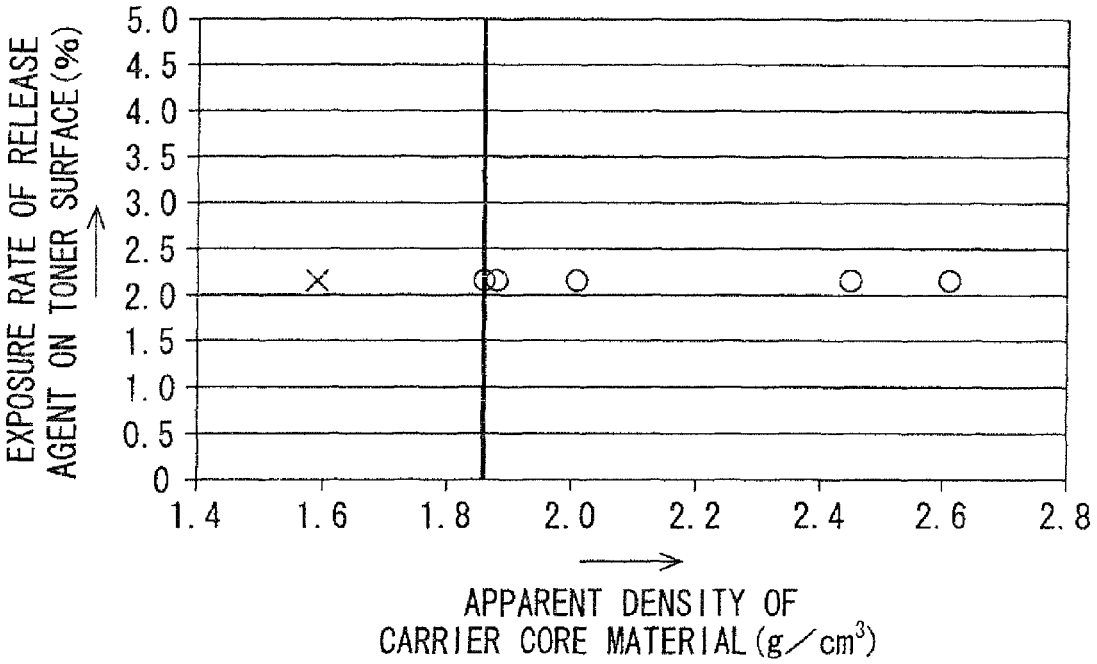
FIG. 3 is a graph showing evaluation results of carrier adhesion using the two-component developers of Examples 1 to 4 and Comparative Examples 1 and 2.

An apparent density (g/cm$^3$) of the carrier core material was shown in x axis, exposure rate of the release agent (%) was shown in y axis, and evaluation results of carrier adhesion shown in Table 4 were plotted. FIG. 3 is a graph showing evaluation results of carrier adhesion using the two-component developers of Examples 5 to 8 and Comparative Examples 1 and 2.

It is seen from FIG. 3 that the two-component developer containing a resin-coated carrier comprising a carrier core material having an apparent density of 1.59 g/cm$^3$ shows large carrier adhesion, and does not reach the practical level. It is further seen that when an apparent density of a carrier core material is 1.86 g/cm$^3$ or more, carrier adhesion is good.

Figure 4:
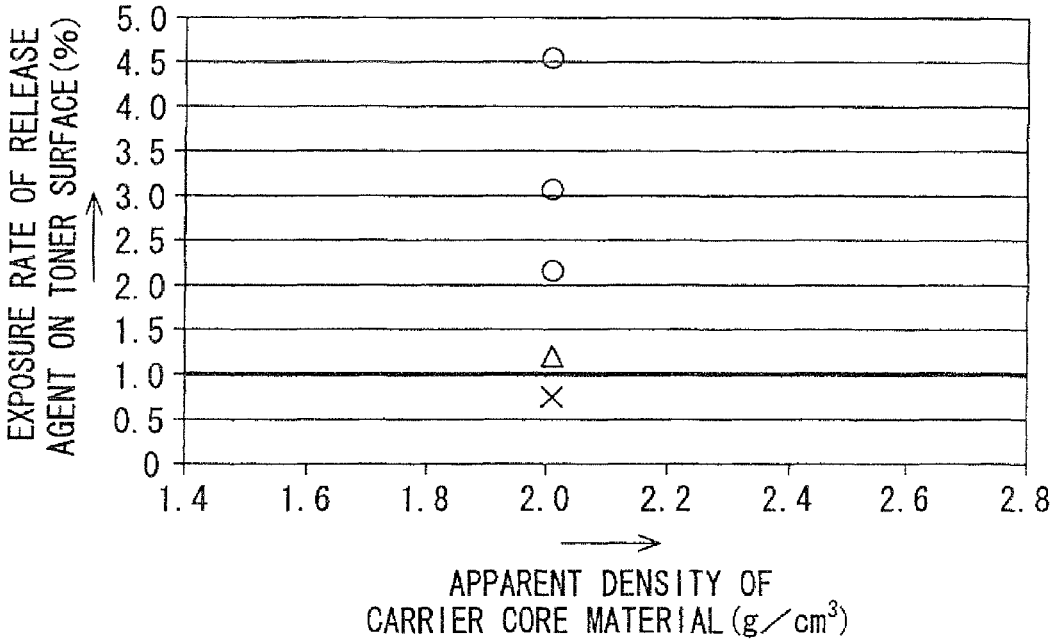
FIG. 4 is a graph showing evaluation results of fixability using the two-component developers of Examples 1 and 5 and Comparative Examples 5, 10 and 16.

An apparent density (g/cm$^3$) of the carrier core material was shown in x axis, exposure rate of the release agent (%) was shown in y axis, and evaluation results of fixability shown in Table 4 were plotted. FIG. 4 is a graph showing evaluation results of fixability using the two-component developers of Examples 1 and 5 and Comparative Examples 5, 10 and 16.

It is seen from FIG. 4 that the two-component developer containing a toner having exposure rate of the release agent of 0.75% has poor fixability, and does not reach the practical level. This is due to that exposure rate of the release agent on the toner surface is too small, and releasability of a toner to a fixing roller is decreased. It is therefore seen that the exposure rate of the release agent requires 1.0% or more in order to make releasability of a toner to a fixing roller good.

Figure 5:
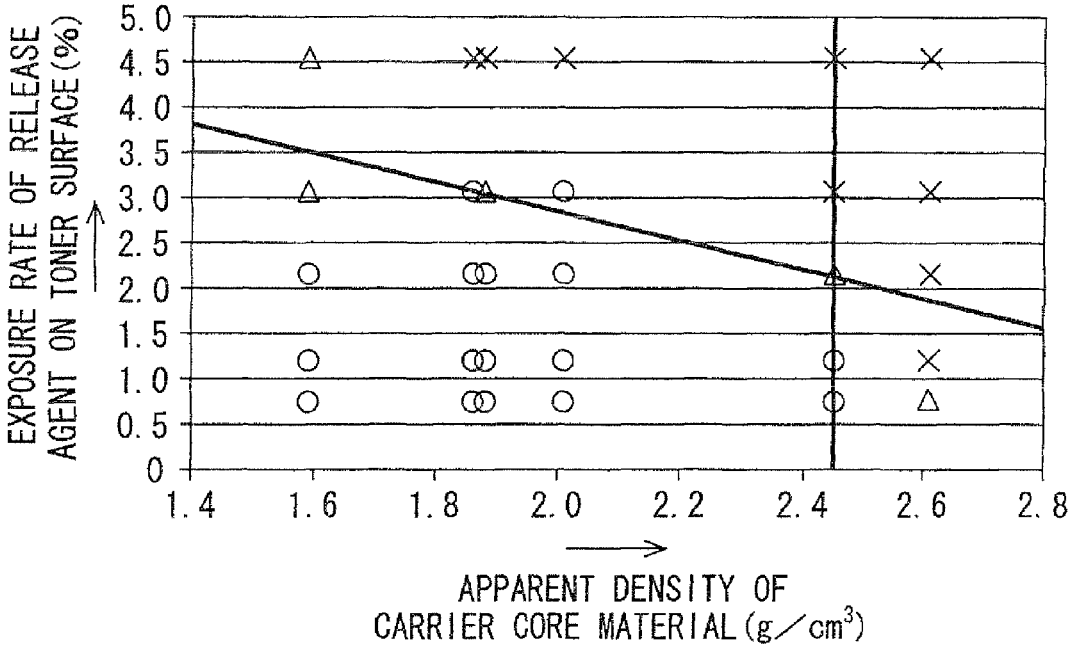
FIG. 5 is a graph showing evaluation results of developer fluidity using the two-component developers of Examples 1 to 9 and Comparative Examples 1 to 21.

Furthermore, an apparent density (g/cm$^3$) of the carrier core material was shown in x axis, exposure rate of the release agent (%) was shown in y axis, and evaluation results of developer fluidity shown in Table 4 were plotted. FIG. 5 is a graph showing evaluation results of developer fluidity using the two-component developers of Examples 1 to 9 and Comparative Examples 1 to 21.

It is seen from FIG. 5 that because the amount of the release agent eluted in a toner surface is decreased as the exposure rate of the release agent on a toner surface is decreased, developer fluidity becomes good. It is further seen that even though the exposure rate of the release agent is increased, developer fluidity is difficult to be decreased for a resin-coated carrier containing a carrier core material having low apparent density, that is, a resin-coated carrier having low specific gravity. It is seen that the two-component developer containing a resin-coated carrier comprising a carrier core material having an apparent density of 2.61 g/cm$^3$ decreases its fluidity even in the case of combining with a toner having relatively small exposure rate of the release agent. The reason for this is that when a resin-coated carrier comprising a carrier core material having an apparent density exceeding 2.45 g/cm$^3$ is used, the use gives very large mechanical stress to a toner when stirring a developer.

As described before, an apparent density of a carrier core material requires 1.86 g/cm$^3$ or more in order to make the evaluation result of carrier adhesion good. Form FIG. 5, the upper limit of the value of y coordinate at which the evaluation result of fluidity is good in a line of x=1.86 is 3.07. Furthermore, the upper limit of the value of y coordinate at which the evaluation result of fluidity is good in a line of x=2.45 is 2.16. The formula of a line connecting the point that x coordinate is 1.86 and y coordinate is 3.07 (1.86, 3.07) and the point that x coordinate is 2.45 and y coordinate is 2.16 (2.45, 2.16) is $y=-1.54x+5.93$. When the range of the formula (1) derived from this line is satisfied and an apparent density of a carrier core material is 2.45 g/cm$^3$ or less, developer fluidity becomes good.

From those facts, when the formula (1) is satisfied, a exposure rate of the release agent is 1.0% or above and 3.07% or below and an apparent density of a carrier core material is from 1.86 g/cm$^3$ or more and 2.45 g/cm$^3$ or less, developer fluidity, carrier adhesion and fixability become good. When the developer fluidity is good, toner charging characteristic becomes good in the above range.

It is seen from the above that a two-component developer comprising a combination of a toner satisfying the formula (1), having a exposure rate of the release agent of 1.0% or above and 3.07% or below and having an apparent density of a carrier core material of 1.86 g/cm$^3$ or more and 2.45 g/cm$^3$ or less, and a resin-coated carrier can stably form a high quality image over a long period of time.

Evaluation of performance of a two-component developer by a size of dispersion diameter of a release agent on a toner surface was conducted using the two-component developers of Example 5 and Example 10. As shown in Table 1, the dispersion diameter of a release agent on the surface of a toner contained in the two-component developer of Example 5 is 200 nm.

Example 10

A two-component developer of Example 10 was obtained by using the toner (6) and the resin-coated carrier (1), and mixing and stirring those under the same condition as in Example 1. As shown in Table 1, the dispersion diameter of a release agent on the surface of a toner contained in the two-component developer of Example 10 is 315 nm.

Evaluation results of developer fluidity, fixability and toner charging characteristic of Example 5 and Example 10 are shown in Table 5. Evaluation methods of developer fluidity, fixability and toner charging characteristic are the same as the evaluation methods of developer fluidity, fixability and toner charging characteristic of Examples 1 to 9 and Comparative Examples 1 to 21.

TABLE 5

| | | | | | | | Toner charge characteristic | | | | | |
|---|---|---|---|---|---|---|---|---|---|---|---|---|
| | | | Developer fluidity | | Fixability | | Initial charging property | | Decay characteristic of charging | | Life characteristic of charging | |
| | | | | | Fixed | | Charge | | Charge amount | | Charge amount | |
| | Kind of carrier | Kind of toner | Δθ (°) | Evaluation | non-offset region (° C.) | Evaluation | amount (μC/g) | Evaluation | difference (μC/g) | Evaluation | difference (μC/g) | Evaluation |
| Example 5 | Resin-coated carrier (1) | Toner (2) | 24 | Good | 50 | Good | −32 | Good | 3 | Good | 4 | Good |
| Example 10 | Resin-coated carrier (1) | Toner (6) | 60 | Not bad | 50 | Good | −26 | Good | 7 | Not bad | 7 | Not bad |

As is apparent from Table 5, the two-component developer of Example 5 containing the toner (2) in which dispersion diameter of a release agent on a toner surface is less 300 nm had excellent developer fluidity and was the level free of problems regarding fixability and toner charging characteristic. The two-component developer of Example 10 containing the toner (6) in which dispersion diameter of a release agent on a toner surface is 300 nm or more was the level free of problem regarding fixability similar to Example 5, but developer fluidity and toner charging characteristic were slightly decreased.

Evaluation of performance of a two-component developer by a size of a volume average particle size of a carrier core material was conducted using the two-component developers of Examples 1 and 10 to 12 and Comparative Examples 23 and 24.

Examples 11 to 15

Two-component developers of Examples 11 to 13 were obtained by using the toner (2) and the resin-coated carriers (7) to (9) containing carrier core materials having a volume average particle size in a range of 25 to 50 μm, and mixing and stirring those under the same conditions as in Example 5.

Two-component developers of Examples 14 and 15 were obtained by using the toner (2), and each of the resin-coated carrier (10) containing a carrier core material having a volume average particle size of 23 μm and the resin-coated carrier (11) containing a carrier core material having a volume average particle size of 52 μm, and mixing and stirring the respective mixtures under the same conditions as in Example 5.

Evaluation results of developer fluidity, carrier adhesion and toner charging characteristic of Examples 5 and 11 to 15 are shown in Table 6. Evaluation methods of developer fluidity, carrier adhesion and toner charging characteristic are the same as the evaluation methods of developer fluidity, carrier adhesion and toner charging characteristic of Examples 1 to 9 and Comparative Examples 1 to 21.

comprising a carrier core material having a volume average particle size of 52 μm slightly decreases toner charging characteristic.

Evaluation of performance of a two-component developer by a size of a volume resistance of a resin-coated carrier was conducted using the two-component developers of Examples 5 and 16 to 20. As shown in Table 2, a volume resistance of the resin-coated carrier contained in the two-component developer of Example 5 is $10^{12}$ Ω·cm.

Examples 16 to 18

Two-component developers of Examples 16 to 18 were obtained by using the toner (2), and each of the resin-coated carrier (12) having a volume resistance of $10^{13}$ Ω·cm, the resin-coated carrier (13) having a volume resistance of $10^{10}$ Ω·cm and the resin-coated carrier (14) having a volume resistance of $10^{14}$ Ω·cm, and mixing and stirring the respective mixtures under the same conditions as in Example 5.

Examples 19 and 20

Two-component developers of Examples 19 and 20 were obtained using the toner (2), and each of the resin-coated carrier (15) having a volume resistance of $10^{9}$ Ω·cm and the

TABLE 6

| | | | Developer fluidity | | Carrier adhesion | | Toner charge characteristic: Initial charging property | | Toner charge characteristic: Decay characteristic of charging | | Toner charge characteristic: Life characteristic of charging | |
|---|---|---|---|---|---|---|---|---|---|---|---|---|
| | Kind of carrier | Kind of toner | Δθ (°) | Evaluation | F | Evaluation | Charge amount (μC/g) | Evaluation | Charge amount difference (μC/g) | Evaluation | Charge amount difference (μC/g) | Evaluation |
| Example 11 | Resin-coated carrier (7) | Toner (2) | 33 | Not bad | 0.80 | Not bad | −35 | Good | 4 | Good | 7 | Not bad |
| Example 12 | Resin-coated carrier (8) | Toner (2) | 28 | Good | 0.35 | Good | −28 | Good | 3 | Good | 5 | Good |
| Example 5 | Resin-coated carrier (1) | Toner (2) | 24 | Good | 0.25 | Good | −32 | Good | 3 | Good | 4 | Good |
| Example 13 | Resin-coated carrier (9) | Toner (2) | 22 | Good | 0.20 | Good | −24 | Not bad | 2 | Good | 7 | Not bad |
| Example 14 | Resin-coated carrier (10) | Toner (2) | 40 | Not bad | 2.10 | Poor | −32 | Good | 4 | Good | 7 | Not bad |
| Example 15 | Resin-coated carrier (11) | Toner (2) | 25 | Good | 0.20 | Good | −24 | Not bad | 8 | Poor | 12 | Poor |

As is apparent from Table 6, when a volume average particle size of a carrier core material is set to 25 μm or more and 50 μm or less, a two-component developer that can reduce carrier adhesion, prevents image deterioration due to carrier particles, and can obtain high definition image quality can be obtained. It is further seen that the two-component developer of Example 14 containing a resin-coated carrier comprising a carrier core material having a volume average particle size of 23 μm slightly decreases carrier adhesion, but charging characteristic to the toner (2) is excellent. The two-component developer of Example 15 containing a resin-coated carrier resin-coated carrier (16) having a volume resistance of $10^{15}$ Ω·cm, and by mixing and stirring the respective mixtures under the same conditions as in Example 5.

Evaluation results of developer fluidity, carrier adhesion and toner charging characteristic of Examples 5 and 16 to 20 are shown in Table 7. Evaluation methods of developer fluidity, carrier adhesion and toner charging characteristic are the same as the evaluation methods of developer fluidity, carrier adhesion and toner charging characteristic of Examples 1 to 9 and Comparative Examples 1 to 21.

TABLE 7

| | | | Developer fluidity | | Carrier adhesion | | Toner charge characteristic: Initial charging property | | Toner charge characteristic: Decay characteristic of charging | | Toner charge characteristic: Life characteristic of charging | |
|---|---|---|---|---|---|---|---|---|---|---|---|---|
| | Kind of carrier | Kind of toner | Δθ (°) | Evaluation | F | Evaluation | Charge amount (μC/g) | Evaluation | Charge amount difference (μC/g) | Evaluation | Charge amount difference (μC/g) | Evaluation |
| Example 5 | Resin-coated carrier (1) | Toner (2) | 24 | Good | 0.25 | Good | −32 | Good | 3 | Good | 4 | Good |
| Example 16 | Resin-coated carrier (12) | Toner (2) | 38 | Not bad | 0.20 | Good | −34 | Good | 4 | Good | 5 | Good |
| Example 17 | Resin-coated carrier (13) | Toner (2) | 22 | Good | 0.60 | Not bad | −36 | Good | 4 | Good | 4 | Good |
| Example 18 | Resin-coated carrier (14) | Toner (2) | 60 | Not bad | 0.30 | Good | −30 | Good | 7 | Not bad | 7 | Not bad |
| Example 19 | Resin-coated carrier (15) | Toner (2) | 25 | Good | 0.90 | Not bad | −28 | Good | 6 | Not bad | 7 | Not bad |
| Example 20 | Resin-coated carrier (16) | Toner (2) | 40 | Not bad | 0.30 | Good | −26 | Good | 7 | Not bad | 7 | Not bad |

As is apparent from Table 7, the two-component developer of Example 19 containing the resin-coated carrier having a volume resistance of $10^9$ Ω·cm receives influence of carrier adhesion, but the degree of influence does not affect image quality deterioration. The two-component developer of Example 20 containing the resin-coated carrier having a volume resistance of $10^{15}$ Ω·cm slightly decreases developer fluidity, decay characteristic of charging and life characteristic of charging, but does not remarkably deteriorate an image. When the volume resistance of the resin-coated carrier is $10^{10}$ Ω·cm or more and $10^{14}$ Ω·cm or less, developer fluidity by life is excellent, carrier adhesion can be reduced, and toner charging characteristic can be made good. As a result, a high quality output image can be obtained over life.

Evaluation of performance of a two-component developer by a size of remanent magnetization which is magnetic characteristic of a carrier core material was conducted using the two-component developers of Examples 5, 7 and 21. As shown in Table 2, remanent magnetization of the carrier core material contained in the two-component developer of Example 1 is 0.5 emu/g, and remanent magnetization of the carrier core material contained in the two-component developer of Example 21 is 6.0 emu/g.

Example 21

Two-component developer of Example 21 was obtained by using the toner (2), and the resin-coated carrier (18) containing the carrier core material having remanent magnetization of 11 emu/g, and mixing and stirring those under the same conditions as in Example 1.

Evaluation results of developer fluidity, carrier adhesion and toner charging characteristic of Examples 5, 7 and 21 are shown in Table 8. Evaluation methods of developer fluidity, carrier adhesion and toner charging characteristic are the same as the evaluation methods of developer fluidity, carrier adhesion and toner charging characteristic of Examples 1 to 9 and Comparative Examples 1 to 21.

TABLE 8

| | | | Developed fluidity | | Carrier adhesion | | Toner charge characteristic: Initial charging property | | Toner charge characteristic: Decay characteristic of charging | | Toner charge characteristic: Life characteristic of charging | |
|---|---|---|---|---|---|---|---|---|---|---|---|---|
| | Kind of carrier | Kind of toner | Δθ (°) | Evaluation | F | Evaluation | Charge amount (μC/g) | Evaluation | Charge amount difference (μC/g) | Evaluation | Charge amount difference (μC/g) | Evaluation |
| Example 5 | Resin-coated carrier (1) | Toner (2) | 24 | Good | 0.25 | Good | −32 | Good | 3 | Good | 4 | Good |
| Example 7 | Resin-coated carrier (3) | Toner (2) | 22 | Good | 0.40 | Good | −30 | Good | 3 | Good | 4 | Good |
| Example 21 | Resin-coated carrier (18) | Toner (2) | 60 | Not bad | 0.30 | Good | −32 | Good | 7 | Not bad | 7 | Not bad |

It is apparent from Table 8 that the two-component developer of Example 21 in which remanent magnetization of a carrier core material is 11 emu/g slightly decreases developer fluidity, decay characteristic of charging and life characteristic of charging. It is further seen that when remanent magnetization of a carrier core material is 10 emu/g or less, there is no influence of agglomeration of carriers to each other by remanent magnetization, and developer fluidity can be obtained over the passage of time.

Evaluation of performance of a two-component developer by a size of an apparent density of a carrier core material was conducted using the two-component developers of Examples 8 and 22. As shown in Table 2, the apparent density of the carrier core material contained in the two-component developer of Example 8 is 2.45 g/cm$^3$.

Example 22

Two-component developer of Example 22 was obtained by using the toner (2) and the resin-coated carrier (17) containing the carrier core material having an apparent density of 2.10 g/cm$^3$, and mixing and stirring those under the same conditions as in Example 8.

Evaluation results of developer fluidity, carrier adhesion and toner charging characteristic of Examples 8 and 22 are shown in Table 9. Evaluation methods of developer fluidity, carrier adhesion and toner charging characteristic are the same as the evaluation methods of developer fluidity, carrier adhesion and toner charging characteristic of Examples 1 to 9 and Comparative Examples 1 to 21.

TABLE 9

| | | | Developer fluidity | | Carrier adhesion | | Toner charge characteristic: Initial charging property | | Toner charge characteristic: Decay characteristic of charging | | Toner charge characteristic: Life characteristic of charging | |
|---|---|---|---|---|---|---|---|---|---|---|---|---|
| | Kind of carrier | Kind of toner | Δθ (°) | Evaluation | F | Evaluation | Charge amount (μC/g) | Evaluation | Charge amount difference (μC/g) | Evaluation | Charge amount difference (μC/g) | Evaluation |
| Example 8 | Resin-coated carrier (4) | Toner (2) | 36 | Not bad | 0.40 | Good | −24 | Not bad | 7 | Not bad | 6 | Not bad |
| Example 22 | Resin-coated carrier (17) | Toner (2) | 60 | Not bad | 0.20 | Good | −34 | Good | 6 | Not bad | 7 | Not bad |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A two-component developer comprising a toner including a binder resin, a colorant and a release agent, the toner having an exposure rate of the release agent on the toner surface of 1.00% or above and 3.07% or below, and the toner having a dispersion diameter of a release agent exposed on the toner surface of 200 nm or less and a resin-coated carrier comprising a carrier core material and a resin coating layer formed on a surface of the carrier core material, the carrier core material being soft ferrite having remanent magnetization of 10 emu/g or less and having an apparent density of 1.86 g/cm$^3$ or more and 2.01 g/cm$^3$ or less, the resin-coated carrier comprising a resin coating layer containing a conductive agent, and having a volume resistance of $10^{12}\Omega\cdot$cm, the carrier core material having a volume average particle size of 35 μm or more and 40 μm or less, the resin coating layer containing a silicone resin having a coupling agent dispersed therein, the toner further including a first charge control agent, the resin coating layer including a second charge control agent, and the first charge control agent and the second charge control agent having a same charging polarity, the exposure rate of the release agent on the toner surface and the apparent density of the carrier core material satisfying the following formula (1):

$$y \leq -1.54x + 5.93 \quad (1)$$

wherein y represents the exposure rate of the release agent on the toner surface, and x represents the apparent density of the carrier core material.

2. An image forming method comprising a step of developing an electrostatic latent image formed on an image bearing member from the two-component developer of claim 1 to form a toner image, and a step of forming a monochromatic image or a multicolor image based on the toner image on a recording medium.

3. The image forming method of claim 2, wherein after the toner image formed on an image bearing member is primarily transferred to an intermediate transfer member, the toner image transferred to the intermediate transfer member is secondarily transferred to a recording medium, thereby forming a monochromic image or a multicolor image based on the toner image on the recording medium.

4. The two-component developer of claim 1, wherein the exposure rate of the release agent on the toner surface is 1.00% or above and 2.16% or below.

* * * * *